US008707932B1

(12) United States Patent
Marin et al.

(10) Patent No.: US 8,707,932 B1
(45) Date of Patent: Apr. 29, 2014

(54) FUEL TRANSFER PUMP SYSTEM

(75) Inventors: Zeljko Marin, Citrus Heights, CA (US); Stephen T. Adelman, Grass Valley, CA (US)

(73) Assignee: Paragon Products, LLC, El Dorado Hills, CA (US)

( * ) Notice: Subject to any disclaimer, the term of this patent is extended or adjusted under 35 U.S.C. 154(b) by 748 days.

(21) Appl. No.: 12/807,138

(22) Filed: Aug. 27, 2010

(51) Int. Cl.
*F02M 37/08* (2006.01)
*F02M 37/04* (2006.01)

(52) U.S. Cl.
USPC ..... 123/497; 123/479

(58) Field of Classification Search
USPC ..... 123/497, 480, 359, 479; 701/107.114
See application file for complete search history.

(56) References Cited

U.S. PATENT DOCUMENTS

| | | | | |
|---|---|---|---|---|
| 4,827,897 | A * | 5/1989 | Yamada et al. | 123/497 |
| 5,042,445 | A | 8/1991 | Peters et al. | |
| 5,398,655 | A | 3/1995 | Tuckey | |
| 5,406,922 | A | 4/1995 | Tuckey | |
| 5,411,002 | A * | 5/1995 | Smitley | 123/497 |
| 5,445,128 | A | 8/1995 | Letang et al. | |
| 5,605,448 | A | 2/1997 | Martin, Sr. | |
| 5,908,286 | A | 6/1999 | Clemmons | |
| 5,992,474 | A | 11/1999 | Miller | |
| 6,119,655 | A * | 9/2000 | Heinitz et al. | 123/447 |
| 6,209,521 | B1 * | 4/2001 | Rembold et al. | 123/456 |
| 6,453,878 | B1 | 9/2002 | Mazet | |
| 6,560,528 | B1 | 5/2003 | Gitlin et al. | |
| 6,579,137 | B2 | 6/2003 | Mabru | |
| 6,609,501 | B2 * | 8/2003 | Doane et al. | 123/458 |
| 6,647,328 | B2 | 11/2003 | Walker | |
| 6,672,147 | B1 * | 1/2004 | Mazet | 73/114.43 |
| 6,925,990 | B1 | 8/2005 | Konopacki | |
| 2005/0229906 | A1 * | 10/2005 | Hosoya | 123/457 |

(Continued)

FOREIGN PATENT DOCUMENTS

| | | | |
|---|---|---|---|
| EP | 0 016236 | A1 | 10/1980 |
| JP | 57193766 | A | 11/1982 |

(Continued)

OTHER PUBLICATIONS

Performance Diesel Warehouse, Inc., Power Edge EZ, website Copyright 2010.
Scope It Out: Automotive Videos News Blog, Exploring the Duramax, website, Oct. 20, 2009.

*Primary Examiner* — Mahmoud Gimie
(74) *Attorney, Agent, or Firm* — Dennis A. DeBoo; Audrey A. Millemann; Weintraub Tobin et al

(57) ABSTRACT

A Fuel transfer pump system comprising a multi-mode control process for transferring fuel. The multi-mode control process comprising a closed loop pressure control mode for maintaining fuel pressure at an outlet of a fuel transfer pump at a substantially constant target pressure and having a soft start mode for bidirectionally ramping up to the target pressure by utilizing an open loop control in combination with the closed loop pressure control mode; a current control mode dynamically switchable from the closed loop pressure control mode for controlling a motor driving the fuel transfer pump as a function of a predetermined current threshold; a DC-bus voltage compensation mode operable with either the closed loop pressure control mode or the current control mode for compensating DC bus voltage sag; and an open loop ramp down mode for ramping open loop motor RPMs to zero from any other mode for shutting down system operation.

20 Claims, 28 Drawing Sheets

(56) References Cited

U.S. PATENT DOCUMENTS

| | | | |
|---|---|---|---|
| 2009/0187326 | A1 | 7/2009 | Rozman et al. |
| 2009/0204308 | A1 | 8/2009 | Manan et al. |
| 2010/0066288 | A1 | 3/2010 | Williams |

FOREIGN PATENT DOCUMENTS

| | | | |
|---|---|---|---|
| JP | 61023838 | A | 2/1986 |
| KR | 20030033264 | A | 5/2003 |
| KR | 20030081676 | A | 10/2003 |

* cited by examiner

Bypassing pins:
11&12
31&32
48&51
70&71
C29 0.1uF
C30 0.1uF
C31 0.1uF
C32 0.1uF
ISO_+5V
ISO_GND
C34 27pF
C33 27pF
Y1 5.0MHz
SOSC1
SOSC2
FIRE_ENABLE
PRESS
T_FUEL
V_BUS
40
U7
dsPIC30F6010A
C36 1nF
C35 0.1uF
H1
MMZ2012Y601B
ISO_GND
ISO_+5V
CAN_RX
CAN_TX
PWM_R_BOT
PWM_R_TOP
PWM_Y_BOT
PWM_Y_TOP
PWM_B_BOT
PWM_B_TOP
MCLR
I_BUS
R_SENSE
Y_SENSE
PGC
PGD
T_MCU
T_FET

FUEL TRANSFER PUMP SYSTEM

FIELD OF THE INVENTION

This invention relates generally to a fuel transfer pump system and, in particular, to a pulse width modulated (PWM) fuel transfer pump system comprising a multi-mode control process for delivering fuel to, for example, a high pressure fuel injection pump. In turn, and in one embodiment, the high pressure fuel injection pump delivers high pressure fuel to a common rail system in fluid communication with fuel injectors that deliver fuel to individual engine cylinders under the control of an electronic or engine control unit (ECU).

BACKGROUND OF THE INVENTION

Diesel Engines in the 900 to 6,600 HP range typically have fuel injection pumps capable of pressurizing fuel up to and over 30,000 psi. Historically, a fuel injection pump has been placed with an injector on each cylinder. Today, most manufacturers have switched to a single fuel injection pump and a high pressure accumulator, known as a "Common Rail." In most applications, the fuel injection pump must be fed by a fuel transfer pump. The fuel transfer pump provides fuel to the fuel injection pump at a sufficient flow rate and pressure to allow for successful operation.

Historically, mechanically driven fuel transfer pumps have been the predominant method of fuel transfer, but not without problems.

For example, a typical mechanically driven fuel transfer pump normally has a dynamic shaft seal which prevents fuel from escaping into the engine or into the environment. This seal can become damaged by wear or debris and leak—creating a safety, reliability, and/or maintenance point.

Additionally, the mechanically driven fuel transfer pump RPM is directly tied to engine speed; however, fuel consumption is not always directly proportional to engine speed and, as a result, the pump must be sized for all possible combinations of fuel consumption and RPM. As a result, the pump provides much more flow than is needed most of the time. Accordingly, this extra flow normally is drained back to the fuel tank and the power required to pump the fuel up to pressure is lost thereby wasting energy.

A further problem with the mechanically driven fuel transfer pump RPM is that when the engine is cranking or idling (lowest RPM) the pump may not have enough lift capability to lift fuel from the main fuel tank to the fuel injection pump. This problem is made worse when the fuel tank is positioned significantly lower than the pump, as in locomotives, where the pump normally has to lift fuel at least 6 feet. This can prevent successful priming and keep fuel from reaching the fuel injection pump. To counter this problem, many manufacturers install a third priming pump that is either hand operated or electric motor driven for lifting fuel from the tank to the fuel transfer pump to prime it before cranking the engine. This creates added cost and complexity.

Today, electric motor driven fuel transfer pumps are an addition to the mechanically driven fuel transfer pumps and take the form of either a DC motor driven fuel transfer pump or an AC motor driven fuel transfer pump.

The DC motor driven fuel transfer pumps are problematic for a variety of reasons. First, a category of DC motor driven fuel transfer pumps utilize a dynamic shaft seal that is similar to the seal used in the mechanical version noted above thereby resulting in the same problem of the seal becoming damaged by wear or debris and resulting in a leak creating a safety, reliability, and/or maintenance point. Another problem associated with the DC motor driven fuel transfer pump is motor brush life. In applications such as locomotives, the pump is expected to operate for up to 10 years of continuous duty. This type of duty cycle results in numerous brush changes thereby increasing maintenance costs and chance of failure.

Current AC motor driven fuel transfer pumps operating in applications where only DC power is available accomplish this through a power inverter that creates an AC output from DC input to drive the AC motor.

The inverter for these pumps operates open loop, which means the controller drives the motor at a maximum RPM when maximum voltage is available. RPM can be slowed by lowering available voltage, but this is not practical when other components on the machine are dependent upon the full voltage. Fuel pressure is regulated by mechanical valves. In this case, as in all examples listed above, the pump is sized for maximum fuel consumption. In normal operation, when maximum fuel is not consumed, the fuel is bypassed back to the tank. This adds heat to the fuel and consumes more electrical power than what is actually required to deliver the necessary fuel and wears pump components faster than necessary. Furthermore, pumping excess fuel drives excessive filter sizing and expense.

For the foregoing reasons, there is a need for a fuel transfer pump that, inter alia, overcomes the significant shortcomings of the known prior-art as delineated hereinabove.

BRIEF SUMMARY OF THE INVENTION

In general, and in one aspect, an embodiment of the invention provides a pulse width modulated (PWM) fuel transfer pump system comprising a multi-mode control process for efficiently delivering fuel to a high pressure fuel injection pump under multiple modes of system and engine operation.

In another aspect, an embodiment of the invention provides a fuel transfer pump system that is a cost effective energy management system that operates on demand and under multiple modes of system and engine operation. Thus, there is a cost savings versus using prior conventional mechanically and electric motor driven fuel transfer pumps.

In another aspect, an embodiment of the invention provides a fuel transfer pump system that comprises an AC Induction motor and a multi-mode control process which dynamically controls the speed of the AC induction motor for delivering a target pressure of fuel to the high pressure fuel injection pump over a broad range of engine operating conditions. Hence, the fuel transfer pump system dynamically controls the delivery of fuel to the high pressure fuel injection pump as opposed to the static delivery of fuel by the prior conventional mechanically and electric motor driven fuel transfer pumps. Accordingly, this control can result in a reduction in filter size and/or extending filter life.

In another aspect, an embodiment of the multi-mode control process of the fuel transfer pump system dynamically switches between multiple modes of control as a function of engine start up, running, and shut down conditions and also as a function of anomalous conditions of operation.

In another aspect, an embodiment of the multi-mode control process of the fuel transfer pump system dynamically compensates for voltage fluctuations of the power source powering the system.

In another aspect, an embodiment of the invention provides a method for controlling a fuel transfer pump delivering fuel to a high pressure fuel injection pump; the method comprising: providing a fuel transfer pump having an inlet port which is connectable in fluid communication with a fuel source and an outlet port which is connectable in fluid communication with a high pressure fuel injection pump; providing a motor for driving the fuel transfer pump for drawing fuel through the inlet port from the fuel source and pumping pressurized fuel out the outlet port; measuring a fuel pressure at a location which is in fluid communication with the outlet port; controlling an operating speed of the motor driving the fuel transfer pump as a function of the measured fuel pressure for defining a closed loop pressure control mode for controlling the measured fuel pressure to a target fuel pressure; measuring a current utilized in operating the motor; comparing the measured current to a predefined threshold current value; correlating the measured current to at least one anomalous condition when indicated by the comparison step; and switching from the closed loop pressure control mode for controlling the operating speed of the motor as a function of the measured fuel pressure to a current control mode for controlling the operating speed of the motor as a function of the measured current when the measured current is correlated by the correlation step to at least the one anomalous condition.

In another aspect, an embodiment of the invention provides a method for minimizing current inrush to a fuel transfer pump upon start up; the method comprising: providing a fuel transfer pump having an inlet port which is connectable in fluid communication with a fuel source and an outlet port which is connectable in fluid communication with a high pressure fuel injection pump; providing a motor for driving the fuel transfer pump for drawing fuel through the inlet port from the fuel source and pumping pressurized fuel out the outlet port; measuring a fuel pressure at a location which is in fluid communication with the outlet port; controlling an operating speed of the motor driving the fuel transfer pump as a function of the measured fuel pressure and a moving fuel pressure; measuring a current utilized in operating the motor; comparing the measured current to a predefined threshold current value; and ramping up the current utilized in operating the motor when the measured current is below the predefined threshold current value as indicated by the comparison step and ramping down the current utilized in operating the motor when the current is above the predefined threshold current value as indicated by the comparison step for providing the moving fuel pressure until the moving fuel pressure reaches a target fuel pressure.

In another aspect, an embodiment of the invention provides a fuel transfer pump system for delivering fuel to a high pressure pump of a fuel injection system, the fuel transfer pump system comprising: a fuel transfer pump having an inlet port which is connectable in fluid communication with a source of fuel and an outlet port which is connectable in fluid communication with a high pressure fuel injection pump; a motor for driving the fuel transfer pump for drawing fuel through the inlet port from the fuel source and pumping pressurized fuel out the outlet port at a target fuel pressure; means for measuring fuel pressure at a location in fluid communication with the outlet port of the fuel transfer pump; means for measuring current utilized in operating the motor; and a controller operatively coupled to the motor and connected in signal communication with the fuel pressure measuring means and the current measuring means, the controller being configured to adaptively switch between a closed loop pressure control mode for controlling an operating speed of the motor for obtaining the target fuel pressure as a function of the measured fuel pressure to a current control mode for controlling the operating speed of the motor as a function of the measured current when the measured current is correlated to at least one anomalous condition based on a comparison between the measured current and a predefined threshold current value.

In a further aspect, an embodiment of the invention provides a non-transitory microcontroller-readable memory containing microcontroller-executable instructions that, when executed by a processor, cause the processor to perform a multi-mode control method of a motor driving a pump, the method comprising: controlling an operating speed of a motor driving a pump for pressurizing fluid as a function of a measured pressure of the pressurized fluid for defining a closed loop pressure control mode for obtaining a target fluid pressure; and switching from the closed loop pressure control mode to a current control mode for controlling the operating speed of the motor as a function of a measured current utilized in operating the motor when the measured current is indicative of at least one anomalous condition.

Accordingly, it should be apparent that numerous modifications and adaptations may be resorted to without departing from the scope and fair meaning of the claims as set forth herein below following the detailed description of the invention.

DETAILED DESCRIPTION OF THE INVENTION

Figure 1:
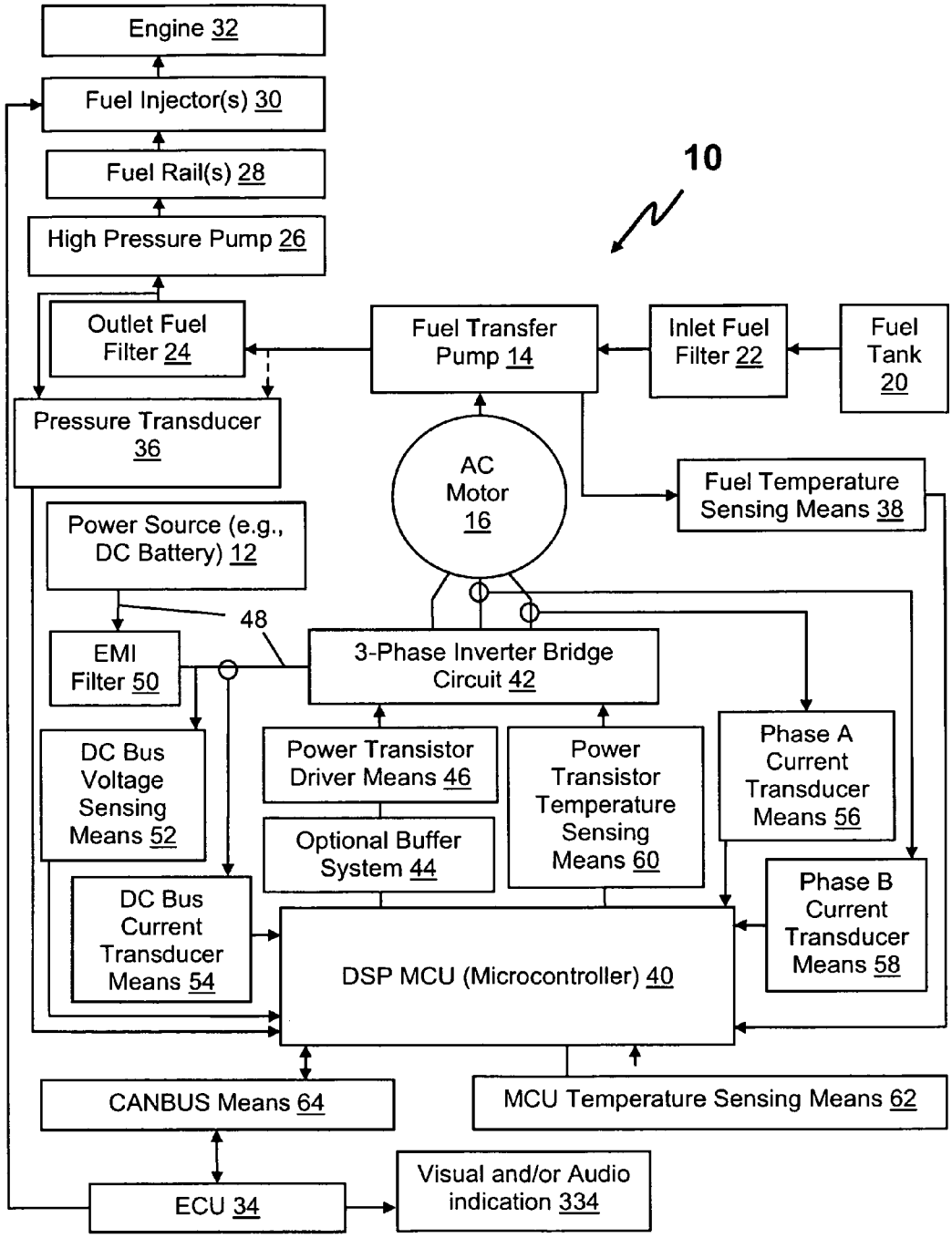
FIG. 1 is a block diagram view of an embodiment of a fuel transfer pump system operatively coupled between a fuel source and a high pressure fuel injection pump.

Considering the drawings, wherein like reference numerals denote like parts throughout the various drawing figures, reference numeral 10 is directed to a fuel transfer pump system: apparatus and method.

System Overview

Figure 2:
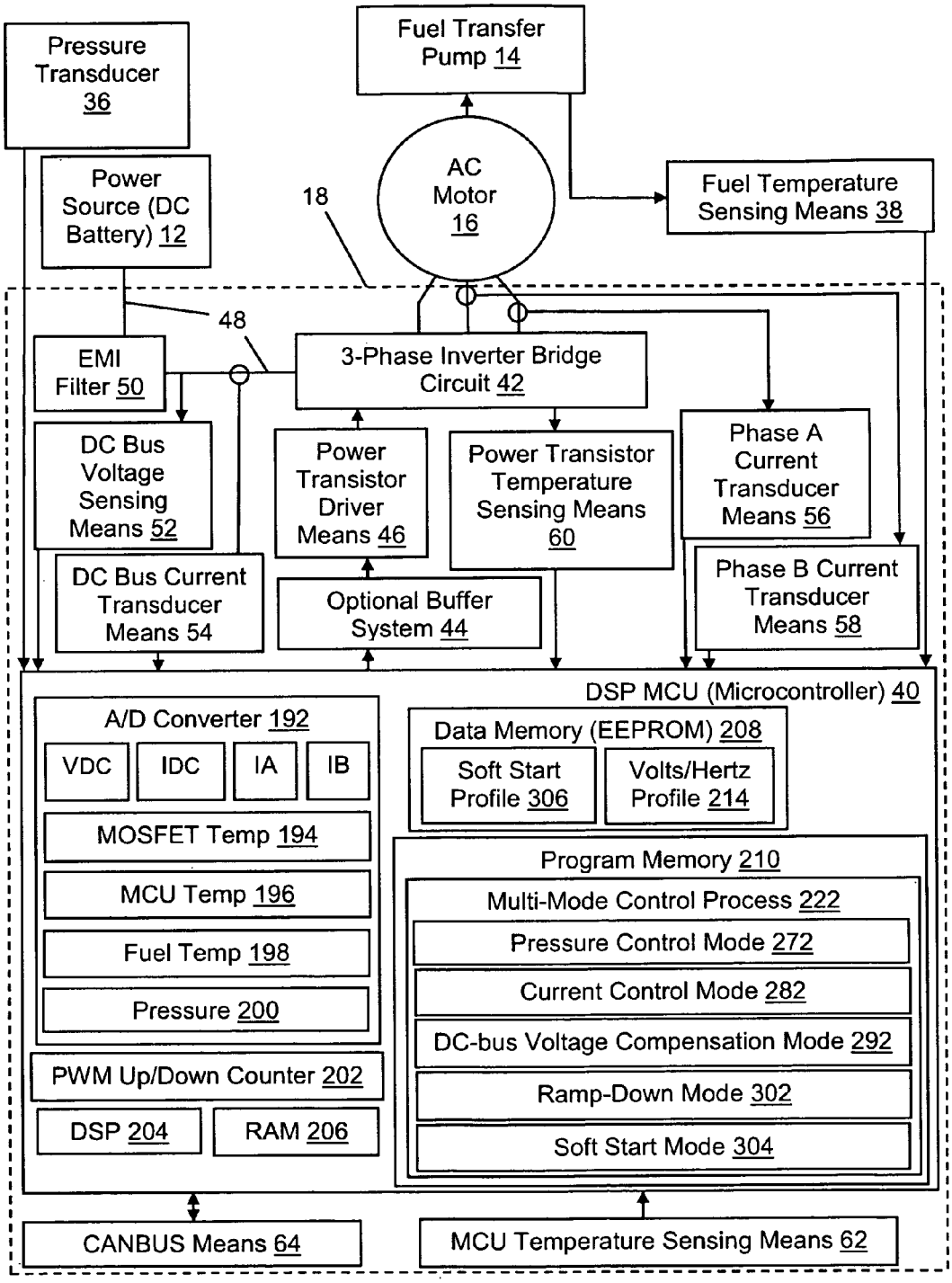
FIG. 2 is a block diagram view of an embodiment of the fuel transfer pump system illustrating additional detail of an embodiment of a microcontroller of the fuel transfer pump system.

In general, and referring to FIGS. 1 and 2, the fuel transfer pump system 10 is powered from an external power source 12 and is comprised of a fuel transfer pump 14, an AC induction motor 16 for driving the pump 14, and a Pulse Width Modulation (PWM) inverter system 18 (FIG. 2), also called a PWM controller 18, for controlling the AC induction motor 16 for driving pump 14. Under the control of the PWM inverter system 18, the AC induction motor 16 drives the pump 14 for drawing or inducing fuel flow from a fuel tank 20 through a stage-one fuel or inlet fuel filter 22 and into the pump 14 via a first fuel line wherein the fuel pump 14 raises the pressure of the fuel flow from a generally ambient condition to a target pressure and pumps the pressurized fuel through a stage-two or outlet fuel filter 24 to a high pressure fuel injection pump 26 via a second fuel line. In turn, the high pressure fuel injection pump 26 further pressurizes the fuel delivered from the fuel transfer pump 14 and supplies the high pressure fuel to at least one common fuel rail 28 which acts as an accumulator of the high pressure fuel. The at least one common fuel rail 28 is connected to a plurality of electrically controlled fuel injectors 30 for individually injecting fuel into cylinders of an internal combustion engine 32 of a vehicle such as a diesel engine under the control of an electronic or engine control unit (ECU) 34 and as a function of operating conditions of the engine 32 of the vehicle.

Additionally, fuel transfer pump system 10 is comprised of a pressure transducer 36 located downstream from the fuel transfer pumnp 14 for measuring the inlet fuel pressure to the high pressure pump 26 for use as will be delineated in detail below. In one embodiment, the pressure transducer 36 is disposed in the second fuel line before the stage-two fuel filter 24. In another embodiment, the pressure transducer 36 is disposed in the second fuel line after the stage-two fuel filter 24. Furthermore, the fuel transfer pump system 10 is comprised of a fuel temperature sensing means 38 located downstream from the fuel tank 20 for measuring the inlet fuel temperature to the fuel transfer pump 14 for use as will be delineated in detail below.

PWM Inverter System

Figure 3:
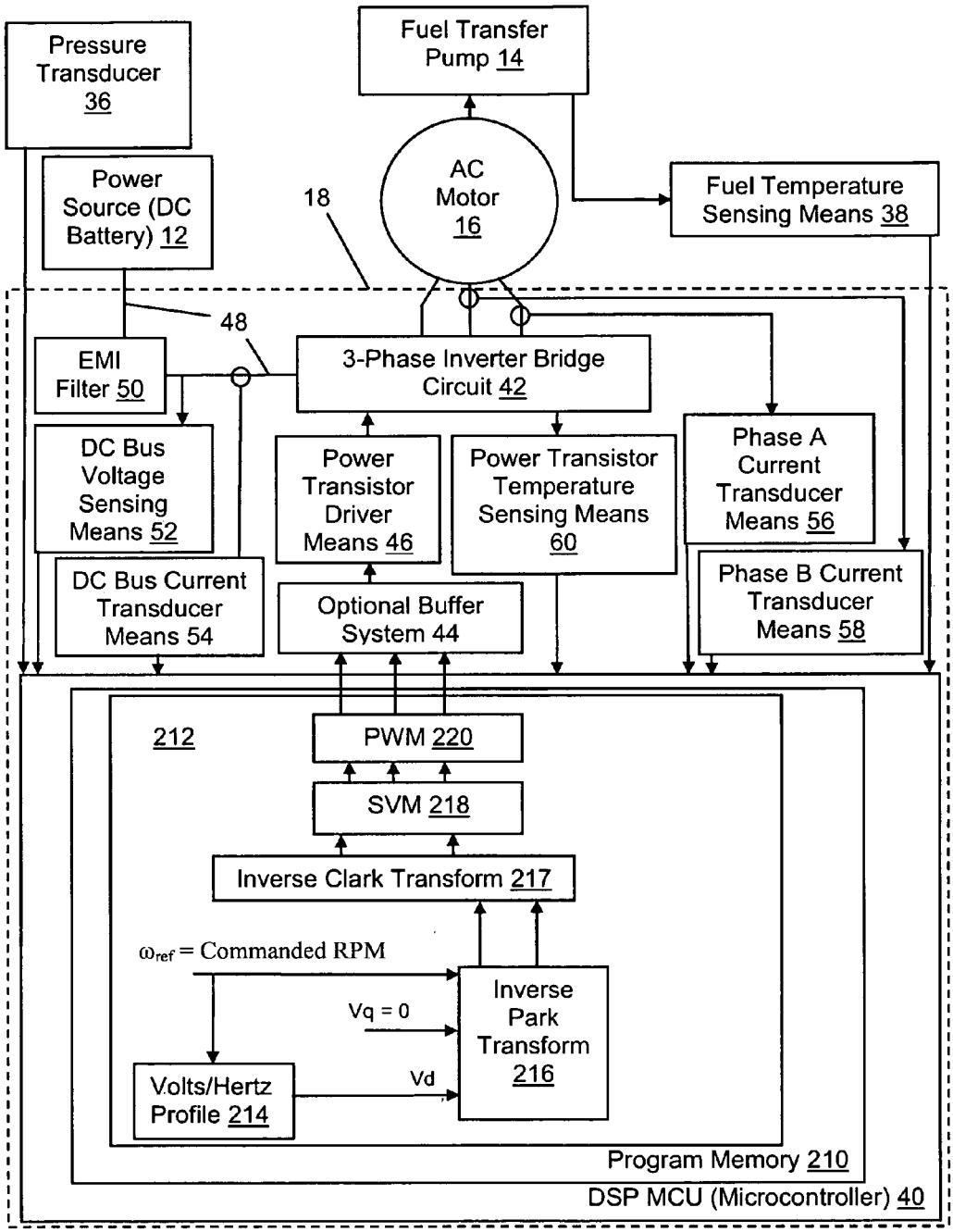
FIG. 3 is a block diagram view of an embodiment of the fuel transfer pump system illustrating further detail of the embodiment of the microcontroller of the fuel transfer pump system.

Referring to FIGS. 1 through 3, the PWM inverter system 18 is comprised of a Digital Signal Processor Microcontroller device 40, abbreviated as Microcontroller 40, operatively coupled to a 3-phase inverter bridge circuit 42 via an optional buffer system 44 and a power transistor Driver circuit 46. A DC bus 48 electrically couples the power source 12 to the 3-phase inverter bridge circuit 42 and an EMI filter 50 filters out noise on the DC bus 48. In one embodiment, the power source 12 can take the form of, but is not limited to, a DC battery such as a 24 or 74 volt battery.

Additionally, the PWM inverter system 18 is comprised of a DC bus voltage sensing means 52, a DC bus current transducer means 54, a first or phase-A current transducer means 56, and a second or phase-B current transducer means 58. The DC bus voltage sensing means 52 and a DC bus current transducer means 54 are both electrically coupled between the DC bus 48 and the Microcontroller 40. The first or phase-A current transducer means 56 and the second or phase-B current transducer means 58 are both electrically coupled between the AC motor 16 and the Microcontroller 40. The PWM inverter system 18 is also comprised of a power transistor temperature sensing means 60, a microcontroller (MCU) temperature sensing means 62, and a CANBUS means 64. The power transistor temperature sensing means 60 is electrically coupled between the three phase inverter bridge circuit 42 and the Microcontroller 40, the microcontroller temperature sensing means 62 is electrically coupled to the Microcontroller 40, and the CANBUS means 64 is electrically coupled between the Microcontroller 40 and the ECU 34 for providing bidirectional communication between the two. Both the pressure transducer 36 and the fuel temperature sensing means 38 are also electrically coupled to the Microcontroller 40.

Furthermore, and referring to FIG. 2, the Microcontroller 40 is comprised of an Analog to Digital (A/D) converter 192 for measuring the DC bus current by sampling an output of the DC bus voltage sensing means 52 for obtaining VDC, for measuring the DC bus current by sampling an output of the DC bus current transducer means 54 for obtaining IDC, for measuring a first or phase-A current by sampling an output of the first or phase-A current transducer means 56 for obtaining IA, for measuring a second or phase-B current by sampling an output of the second or phase-B current transducer means 58 for obtaining IB, for measuring power transistor or MOSFET temperature by sampling an output of the power transistor temperature sensing means 60 for obtaining MOSFET temperature 194, for measuring microcontroller temperature by sampling an output of the microcontroller (MCU) temperature sensing means 62 for obtaining MCU temperature 196, for measuring fuel temperature by sampling an output of the fuel temperature sensing means 38 for obtaining fuel temperature 198, and for measuring pressure by sampling an output of the pressure transducer 36 for obtaining pressure 200. In one embodiment, the pressure transducer 36 can take the form of, but not limited to, part number 100CP7-4 supplied by Sensata.

Moreover, the Microcontroller 40 is comprised PWM up/down counter 202, a digital signal processor 204, a RAM 206, a data memory 208 which, in one embodiment, is in a form of a EEPROM, and a program memory 210 all of which will be further detailed below.

Schematically Depicted PWM Inverter System

More specifically, one embodiment of the PWM inverter system or controller 18 is schematically depicted in FIGS. 4 through 23.

Figure 4:
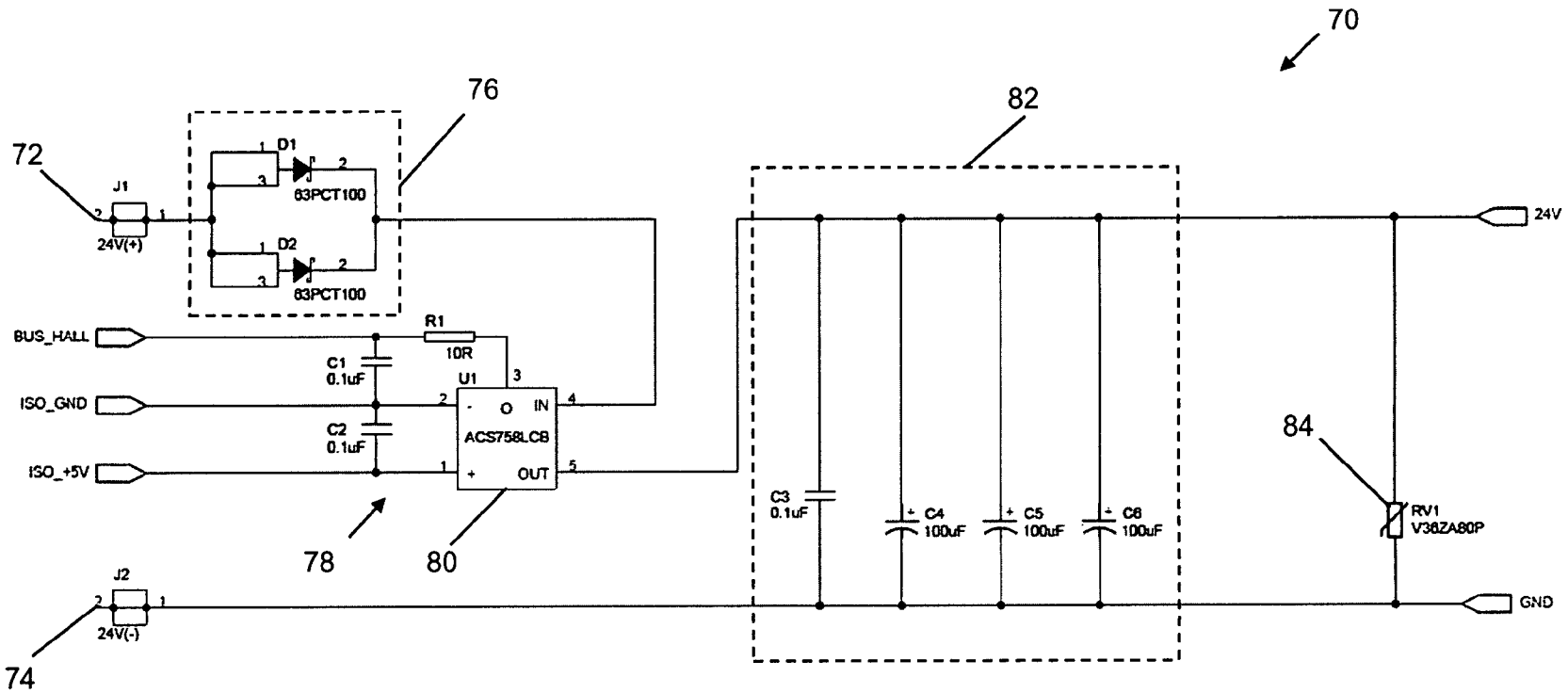
FIGS. 4 through 23 are schematic views that detail of an embodiment of a Pulse Width Modulation (PWM) inverter system, also called a PWM controller, of the fuel transfer pump system.

FIG. 4 schematically details a power input and bus current measurement circuitry 70 comprised of a pair of terminals 72 and 74 for electrically coupling to the power source 12; a polarity protection circuit 76 comprised of a pair of Schottky diodes for protecting the PWM inverter system 18 from a reverse polarity connection with the power source 12 wherein each Schottky diode is, but not limited to model number 63PCT100 sold by Vishay Intertechnology, Inc.; a DC bus Current transducer 80 which, in one embodiment, is a thermally enhanced, fully integrated, hall effect-based linear current sensor IC which, in one embodiment, is model number ACS758LCB sold by Allegro MicroSystems, Inc.; a EMI filter 82 that filters out noise on the DC bus 48; and a varistor 84 for providing MOSFET overvoltage protection. Accordingly, EMI filter 82 schematically illustrated in FIG. 4 forms the EMI filter 50 illustrated in FIGS. 1 through 3. Additionally, DC bus Current transducer 80 along with the associated electronics schematically illustrated in FIG. 4 form the DC bus current transducer means 54 illustrated in FIGS. 1 through 3.

Figure 5:
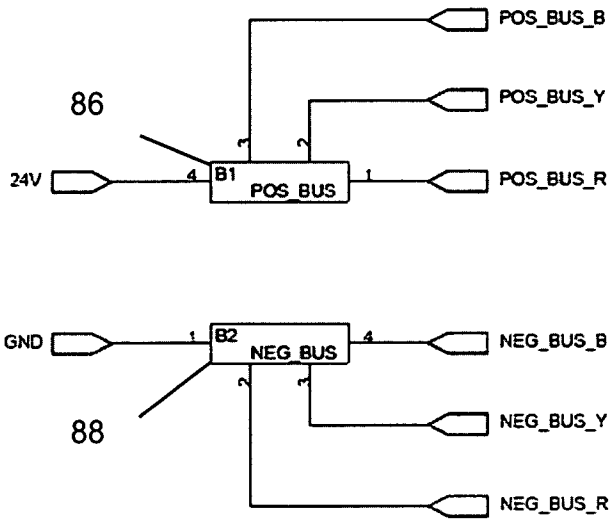
Figure 6:
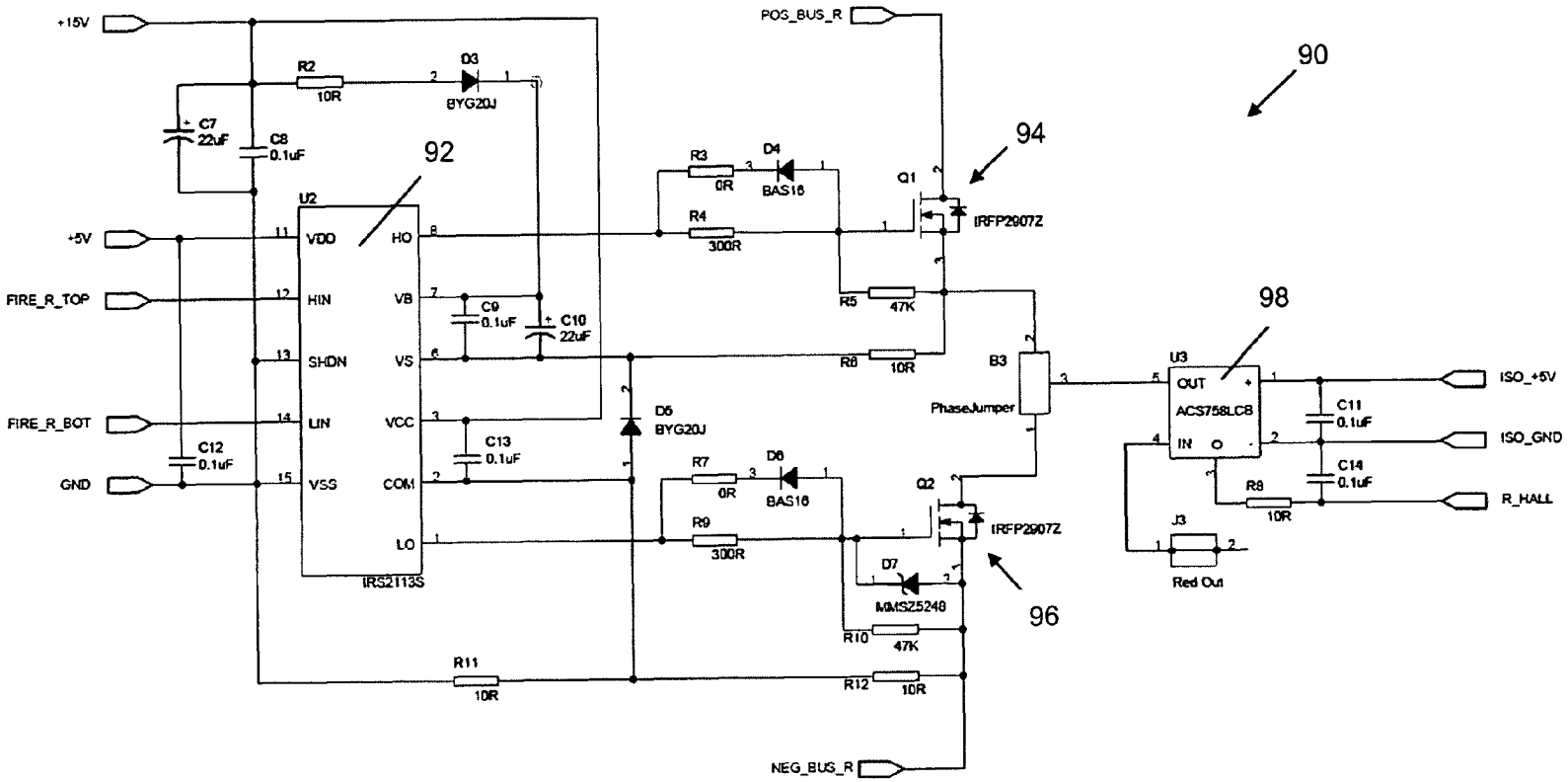
Figure 7:
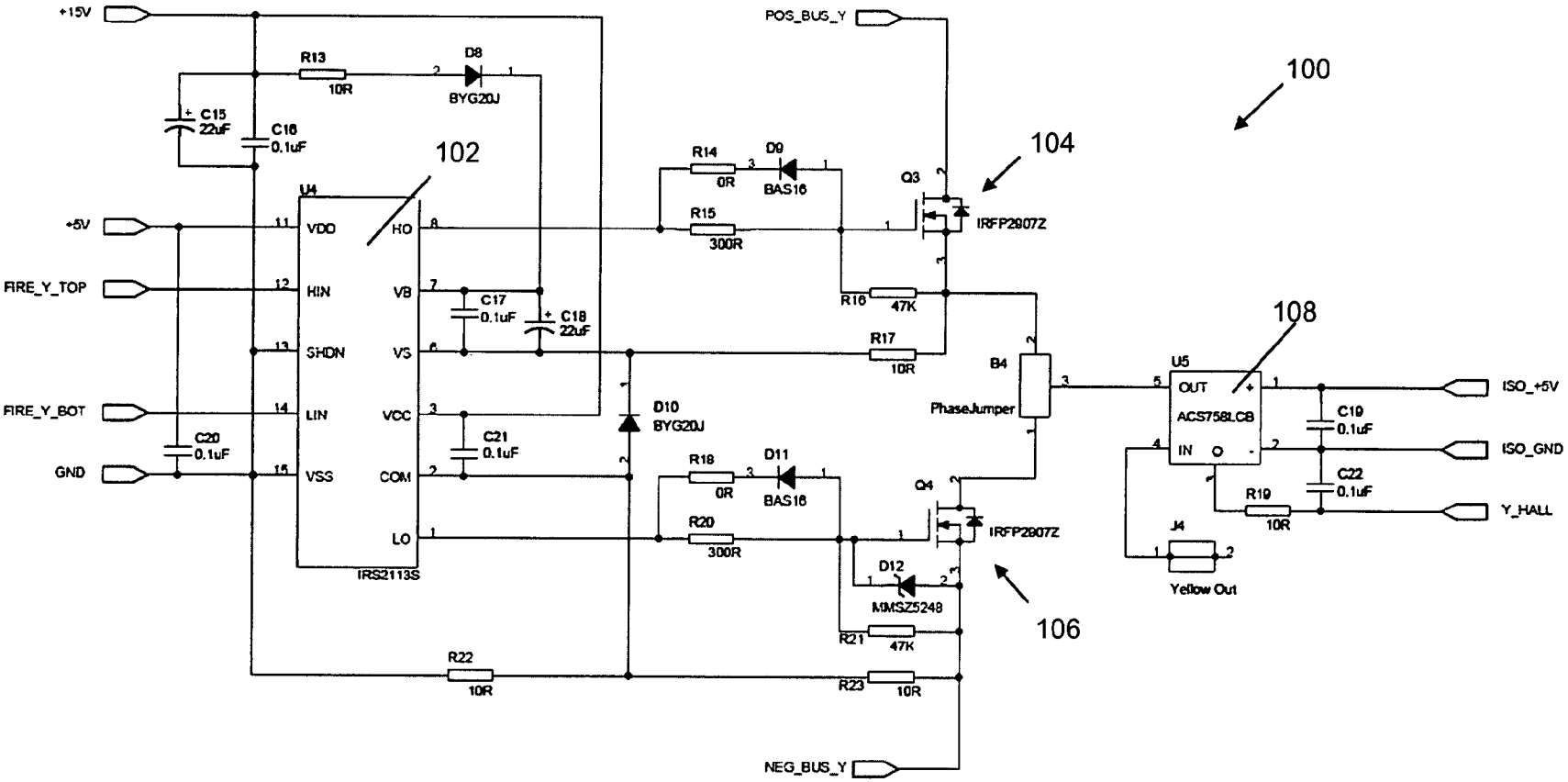
Figure 8:
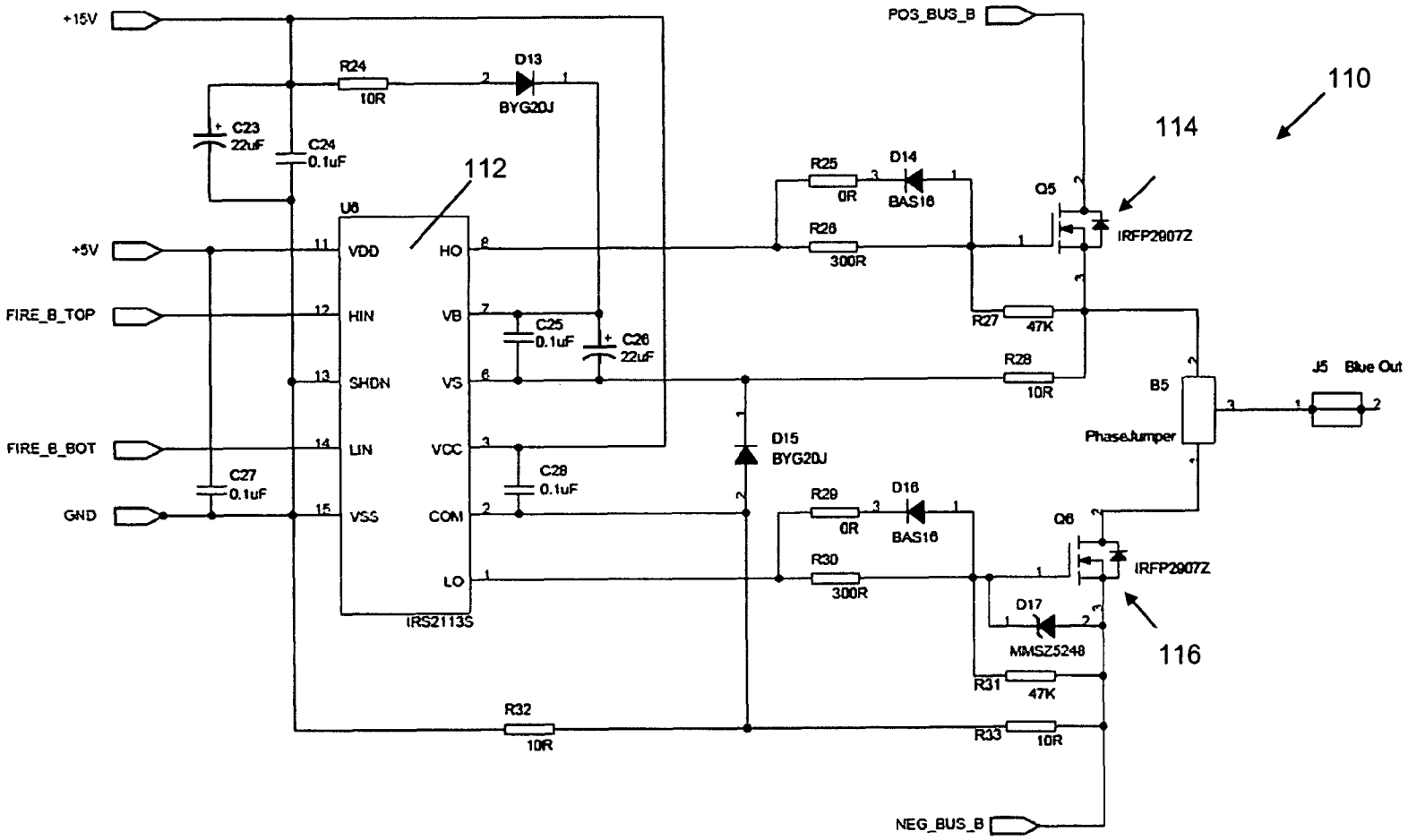

FIG. 5 schematically details positive and negative bus bar connectors 86 and 88 respectively for operatively coupling the DC bus 48 to a red phase half-bridge circuit 90, a yellow phase half-bridge circuit 100, and a blue phase half-bridge circuit 110 as illustrated in FIGS. 6 through 8 respectively.

FIG. 6 schematically details the red phase half-bridge circuit 90 comprised of a high voltage, high speed power MOSFET driver 92 which, in one embodiment, is model number IRS2113S sold by International Rectifier; a first top power MOSFET 94 which, in one embodiment, is model number IRFP2907Z sold by International Rectifier; a first bottom power MOSFET 96 which, in one embodiment, is model number 1RFP2907Z sold by International Rectifier; and a thermally enhanced, fully integrated, hall effect-based linear current sensor IC 98 which, in one embodiment, is model number ACS758LCB sold by Allegro MicroSystems, Inc. Capacitors C9 and C10 are bootstrap capacitors discussed in FIG. 24. Accordingly, power MOSFET driver 92 and the associated electronics schematically illustrated in FIG. 6 form part of the power transistor driver means 46. Additionally, power MOSFETs 94 and 96 along with the associated electronics schematically illustrated in FIG. 6 form part of the 3-phase inverter bridge circuit 42. Furthermore, current sensor IC 98 along with the associated electronics schematically illustrated in FIG. 6 form the phase-A current transducer means 56.

FIG. 7 schematically details the yellow phase half-bridge circuit 100 comprised of a high voltage, high speed power MOSFET driver 102 which, in one embodiment, is model number IRS2113S sold by International Rectifier; a second top power MOSFET 104 which, in one embodiment, is model number IRFP2907Z sold by International Rectifier; a second bottom power MOSFET 106 which, in one embodiment, is model number IRFP2907Z sold by International Rectifier; and a thermally enhanced, fully integrated, hall effect-based linear current sensor IC 108 which, in one embodiment, is model number ACS758LCB sold by Allegro MicroSystems, Inc. Capacitors C17 and C18 are bootstrap capacitors discussed in FIG. 24. Accordingly, power MOSFET driver 102 and the associated electronics schematically illustrated in FIG. 7 form another part of the power transistor driver means 46. Additionally, power MOSFETs 104 and 106 along with the associated electronics schematically illustrated in FIG. 7 form another part of the 3-phase inverter bridge circuit 42. Furthermore, current sensor IC 108 along with the associated electronics schematically illustrated in FIG. 7 form the phase-B current transducer means 58.

FIG. 8 schematically details the blue phase half-bridge circuit 110 comprised of a high voltage, high speed power MOSFET driver 112 which, in one embodiment, is model number IRS2113S sold by International Rectifier; a third top power MOSFET 114 which, in one embodiment, is model number IRFP2907Z sold by International Rectifier; and a third bottom power MOSFET 116 which, in one embodiment, is model number IRFP2907Z sold by International Rectifier. Capacitors C25 and C26 are bootstrap capacitors discussed in FIG. 24. Accordingly, power MOSFET driver 112 and the associated electronics schematically illustrated in FIG. 8 form a further part of the power transistor driver means 46. Additionally, power MOSFETs 114 and 116 along with the associated electronics schematically illustrated in FIG. 8 form a further part of the 3-phase inverter bridge circuit 42.

Figures 9A, 9B:
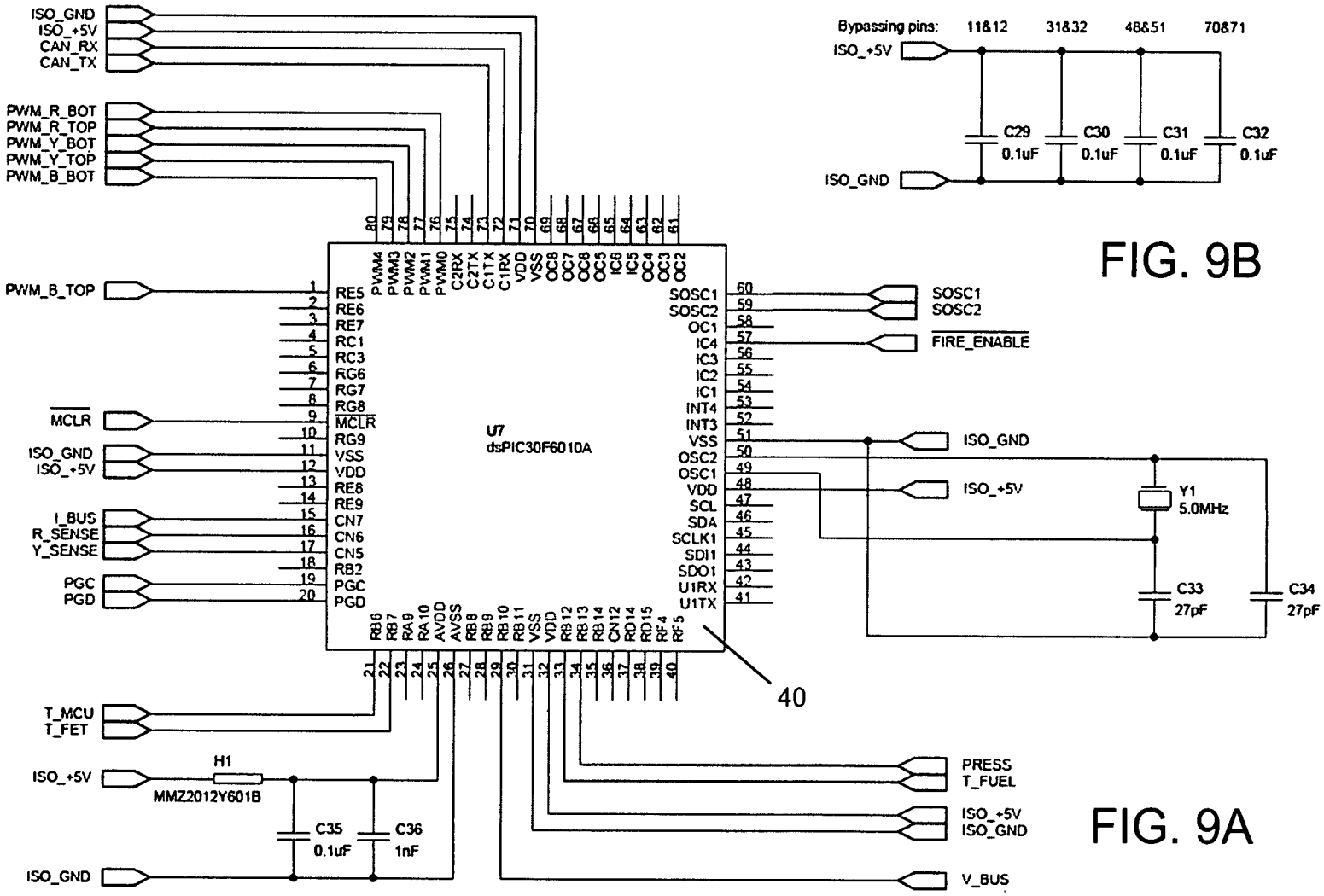
Figure 10:
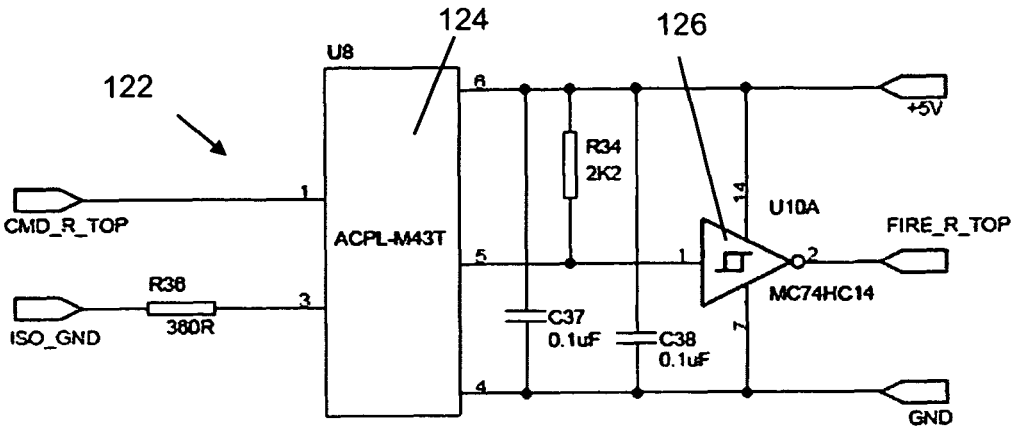
Figure 11:
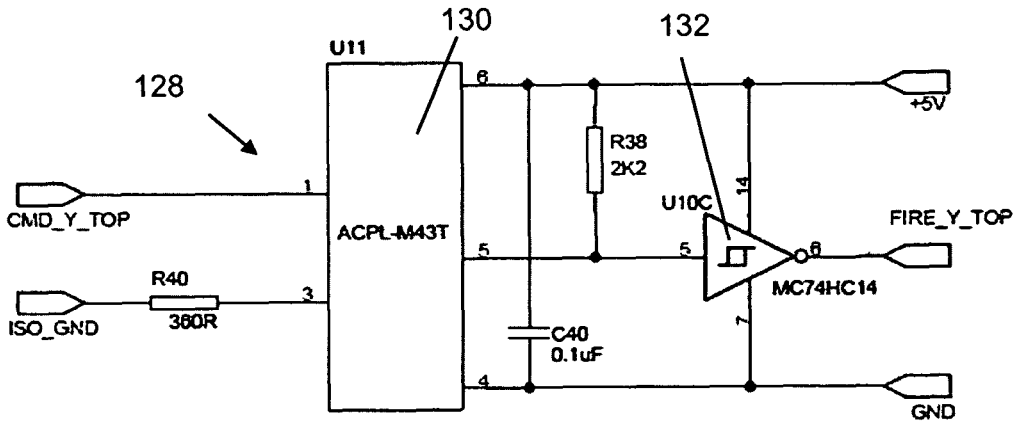
Figure 12:
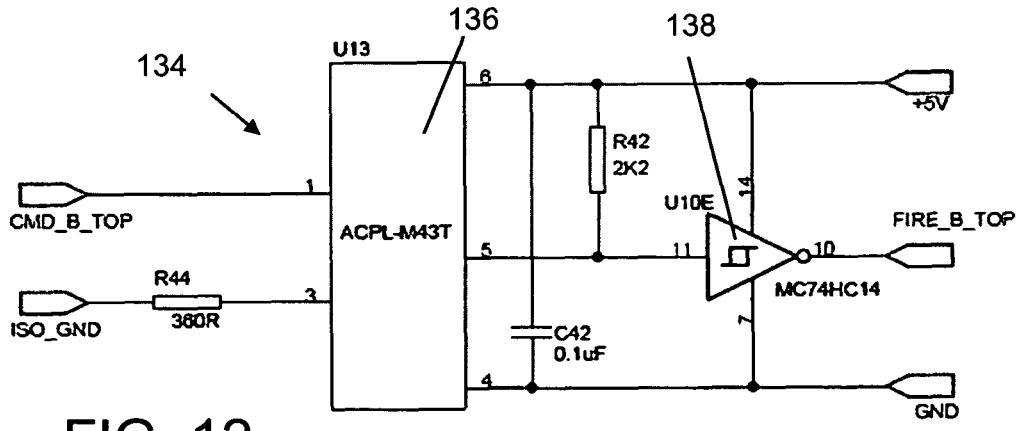
Figure 13:
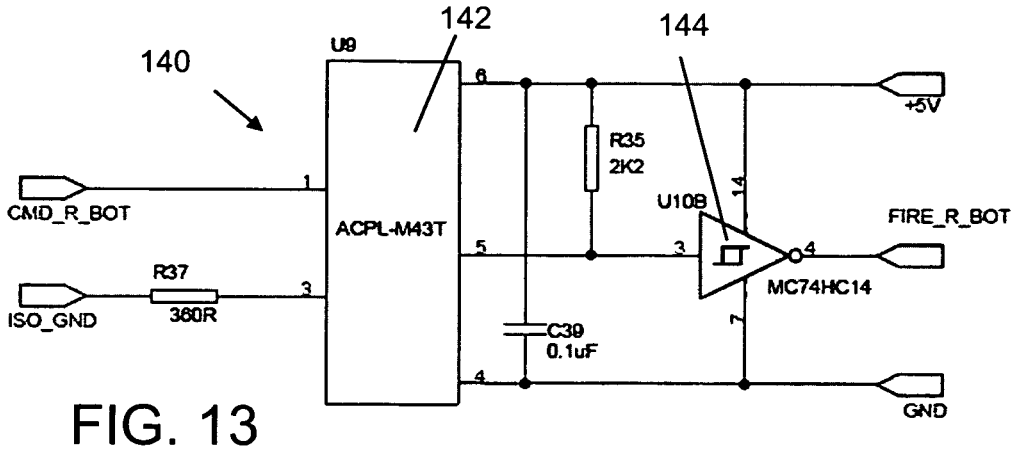
Figure 14:
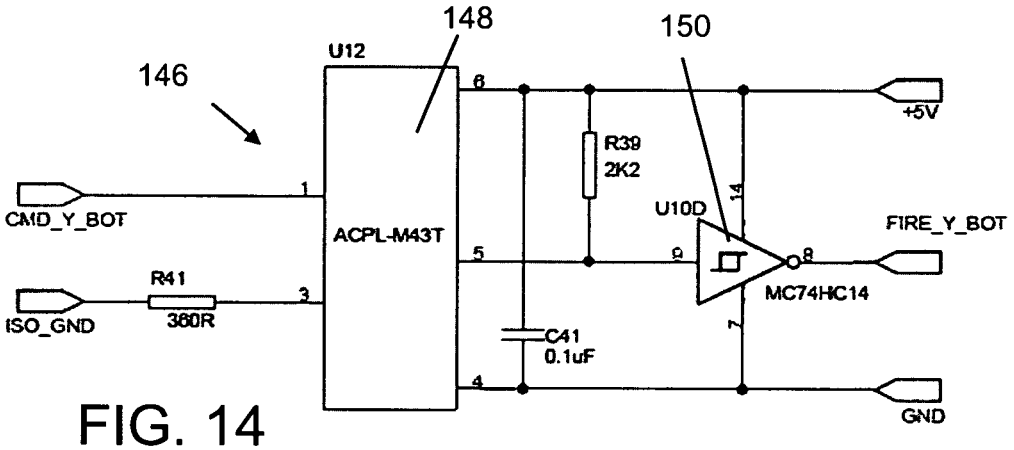
Figure 15:
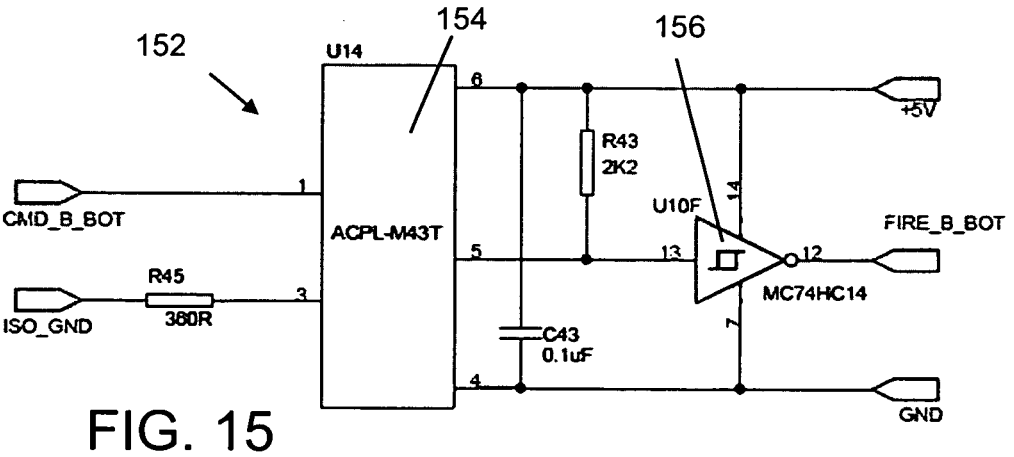

FIG. 9A schematically details the pinouts and connections of the Digital Signal Processor (DSP) Microcontroller (MCU) device 40 which, in one embodiment, is an enhanced flash 16-bit Digital Signal Controller (DSC) sold by Microchip Technology Incorporated under model number dsPIC30F6010A. FIG. 9B schematically detail bypass capacitors that dampen the AC component for supply voltage. Usually it is high frequency AC noise superposed on DC supply voltage. Another term used for the bypass capacitor is a filter cap.

Figure 16:
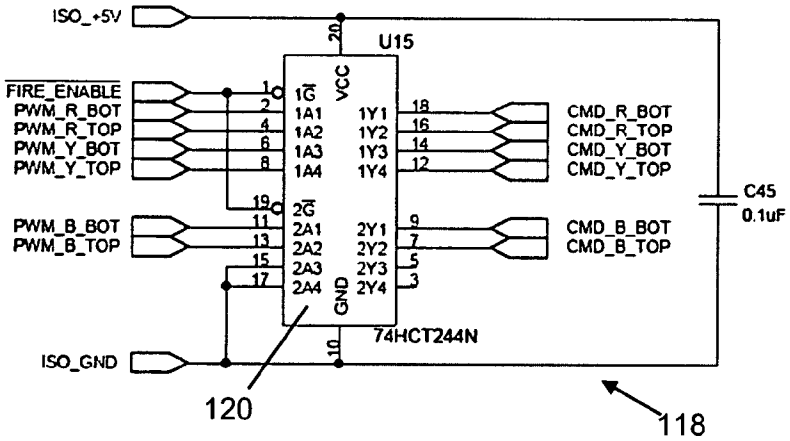

FIGS. 10 through 16 schematically detail one embodiment of the optional buffer system 44 illustrated in at least FIG. 1. FIG. 16 schematically details a buffer circuit 118 comprised of a buffer device 120 which, in one embodiment, is model number 74HCT244N sold by Philips Semiconductors. Buffer circuit 118 is electrically connected between the Microcontroller device 40 and each of the digital isolation circuits 122, 128, 134, 140, 146, and 152 which are respectively comprised of optocouplers 124, 130, 136, 142, 148, and 154 which are each respectively followed by Schmitt-Triggers 126, 132, 138, 144, 150, and 156. In one embodiment, each optocoupler is, but not limited to, model number ACPL-M43T sold by Avago Technologies and each Schmitt-Trigger is, but not limited to, model number MC74HC14A sold by Motorola, Inc.

Figure 17:
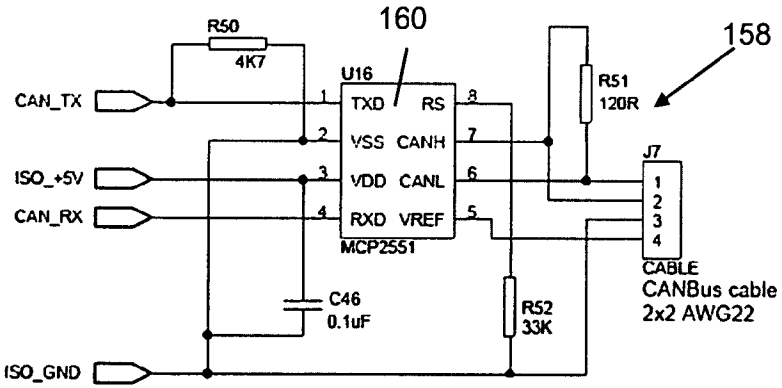

FIG. 17 schematically details an embodiment of a CANBUS circuit 158 of the CANBUS means 64 illustrated in at least FIG. 1 wherein the CANBUS circuit 158 is comprised of a high-speed CAN transceiver 160 for providing bidirectional serial communication between the Microcontroller 40 and the ECU 34. In one embodiment, CAN transceiver 160 is, but not limited to model number MCP2551 sold by Microchip Technology Inc.

Figure 18:
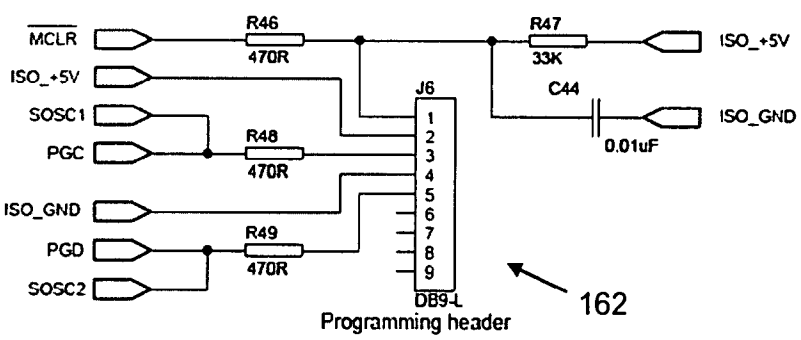

FIG. 18 schematically details a programming header 162.

Figure 19:
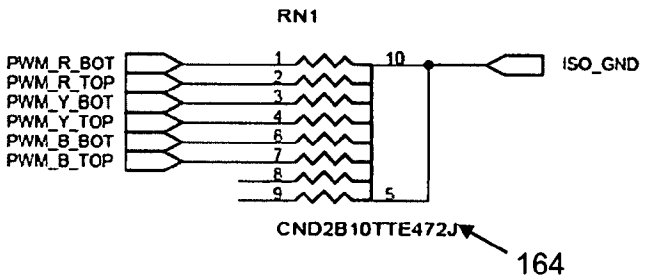

FIG. 19 schematically details a pull down resistor circuit 164 that couples between the PWM pinouts of the Microcontroller 40 and isolated ground.

Figure 20:
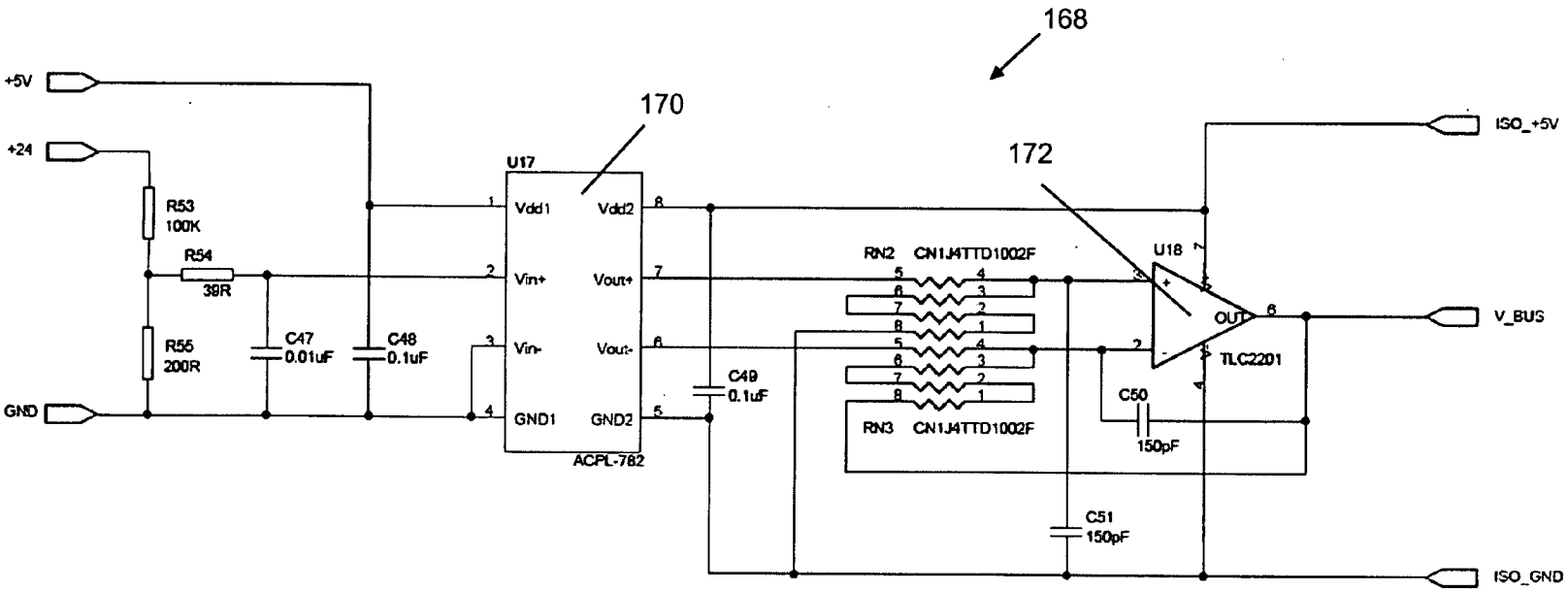

FIG. 20 schematically details an embodiment of a bus voltage sensor circuit 168 of the DC bus voltage sensing means 52 illustrated in at least FIG. 1. The bus voltage sensor circuit 168 is comprised of an isolation amplifier 170 followed by a low-noise operational amplifier 172. In one embodiment, isolation amplifier 170 is, but not limited to, model number ACPL-782 sold by Avago Technologies and low-noise operational amplifier 172 is, but not limited to, model number TLC2201 sold by Texas Instruments Incorporated.

Figure 21:
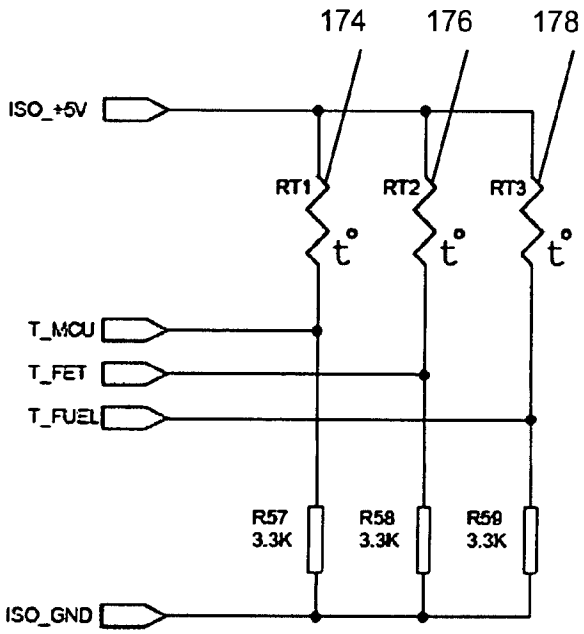

FIG. 21 schematically details a temperature sensing circuit comprised of a Microcontroller temperature sensor 174, a FET temperature sensor 176, and a Fuel temperature sensor 178. These three temperature sensors along with the associated electronics schematically depicted in FIG. 21 provide specific embodiments of the MCU temperature sensing means 62, the power transistor temperature sensing means 60, and the fuel temperature sensing means 38 respectively. The Microcontroller temperature sensor 174 can be adhered directly to the Microcontroller 40, the FET temperature sensor 176 can be adhered directly to the power MOSFETs, and the Fuel temperature sensor 178 can be adhered directly to the first fuel line traversing between the fuel tank 20 and the fuel pump 14. In one embodiment, Microcontroller temperature sensor 174, FET temperature sensor 176, and Fuel temperature sensor 178 are, but not limited to, model 100K thermistors manufactured by GE Sensing and sold under part number RL0503-55.36K-122-MS.

Figure 22:
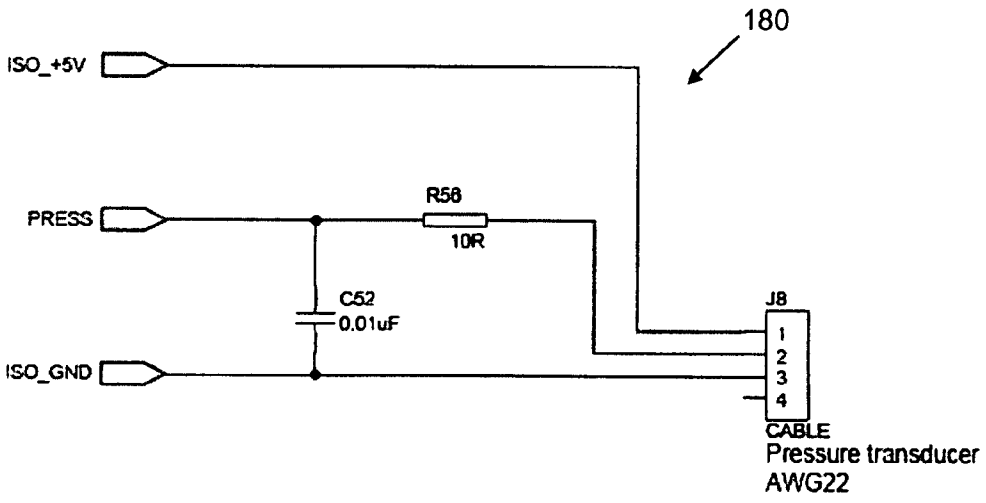

FIG. 22 schematically details a pressure interface circuit 180 interposed between the pressure transducer 36 and the Microcontroller 40.

Figure 23:
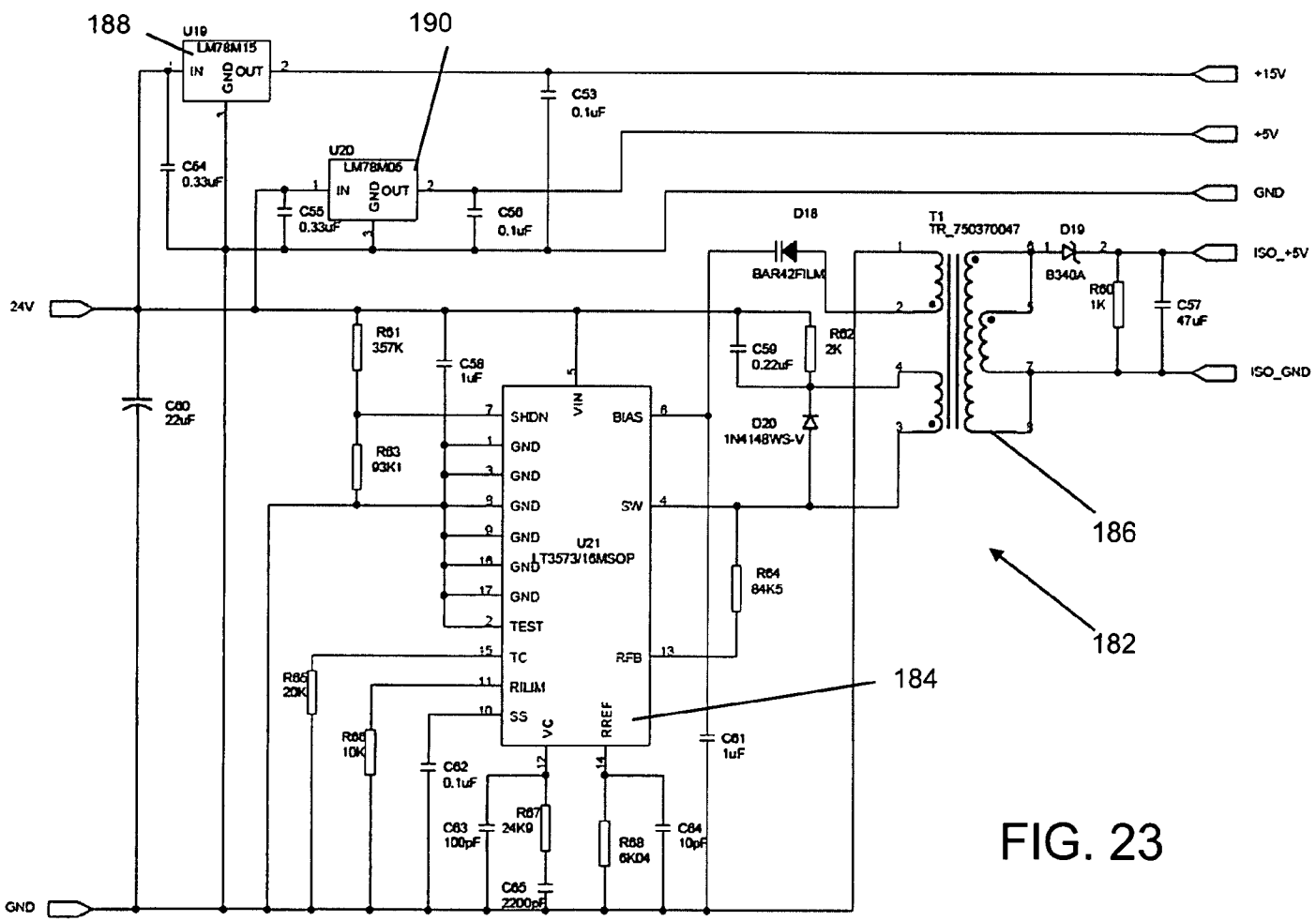

FIG. 23 schematically details a low voltage power supply circuit 182 that electrically couples to the poer source 12 for providing low voltage power to the electronics of the PWM inverter system 18. The low voltage power supply circuit 182 is comprised of a monolithic switching regulator 184 and a transformer 186 along with the schematically illustrated discrete components for providing an isolated 5 volt DC power supply, a 15 Volt Voltage Regulator 188 along with the schematically illustrated discrete components for providing a 15 volt DC power supply, and a 5 Volt Voltage Regulator 190 along with the schematically illustrated discrete components for providing a 5 volt DC power supply. In one embodiment, monolithic switching regulator 184 is, but not limited to, model number LT3573 sold by Linear Technology; transformer 186 is, but not limited to, model number 370047 sold by WE-Midcom, Inc.; Voltage Regulator 188 is, but not limited to, model number LM78M15 sold by National Semiconductor; and Voltage Regulator 190 is, but not limited to, model number LM78M05 sold by National Semiconductor.

Multi Mode Control Process/Method

Referring back to FIGS. 1 and 2, and in one embodiment, the fuel transfer pump system 10 is comprised of a multi-mode control process 222 for controlling the AC induction motor 16 for driving pump 14 for pumping fluid such as fuel to, for example, a high pressure fuel injection pump 26. In turn, the high pressure fuel injection pump 26 provides high-pressure fuel to at least one common fuel rail 28 in fluid communication with the plurality of electrically controlled fuel injectors 30 which individually inject fuel into respective cylinders of the internal combustion engine 32 such as a diesel engine under the control of the ECU 34 and as a function of operating conditions of the engine 32 of the vehicle.

The multi-mode control process 222 is comprised of coded instructions that are stored in a program memory 210 of the Microcontroller 40 and that are illustrated in flowchart form in FIGS. 24 through 33. In one embodiment, the program memory 210 is a non-transitory Microcontroller-readable medium such as such as non-volatile flash memory that stores coded instructions embodying or utilized by any one or more of the processes or methods described herein. The coded instructions may also reside, completely or at least partially, within a RAM memory 206 and/or within a DSP 204 during execution thereof by the Microcontroller 40 wherein the RAM memory 206 and the processor 204 also constitute non-transitory Microcontroller-readable media. Coded instructions may further be transmitted or received via the CANBUS means 64 utilizing an associated protocol. The Microcontroller 40 is also comprised of data memory 208 such as a non-volatile EEPROM for storing static or working data, look-up tables, profiles, or curves.

Outer Lower Priority Loop Process

Figure 24:
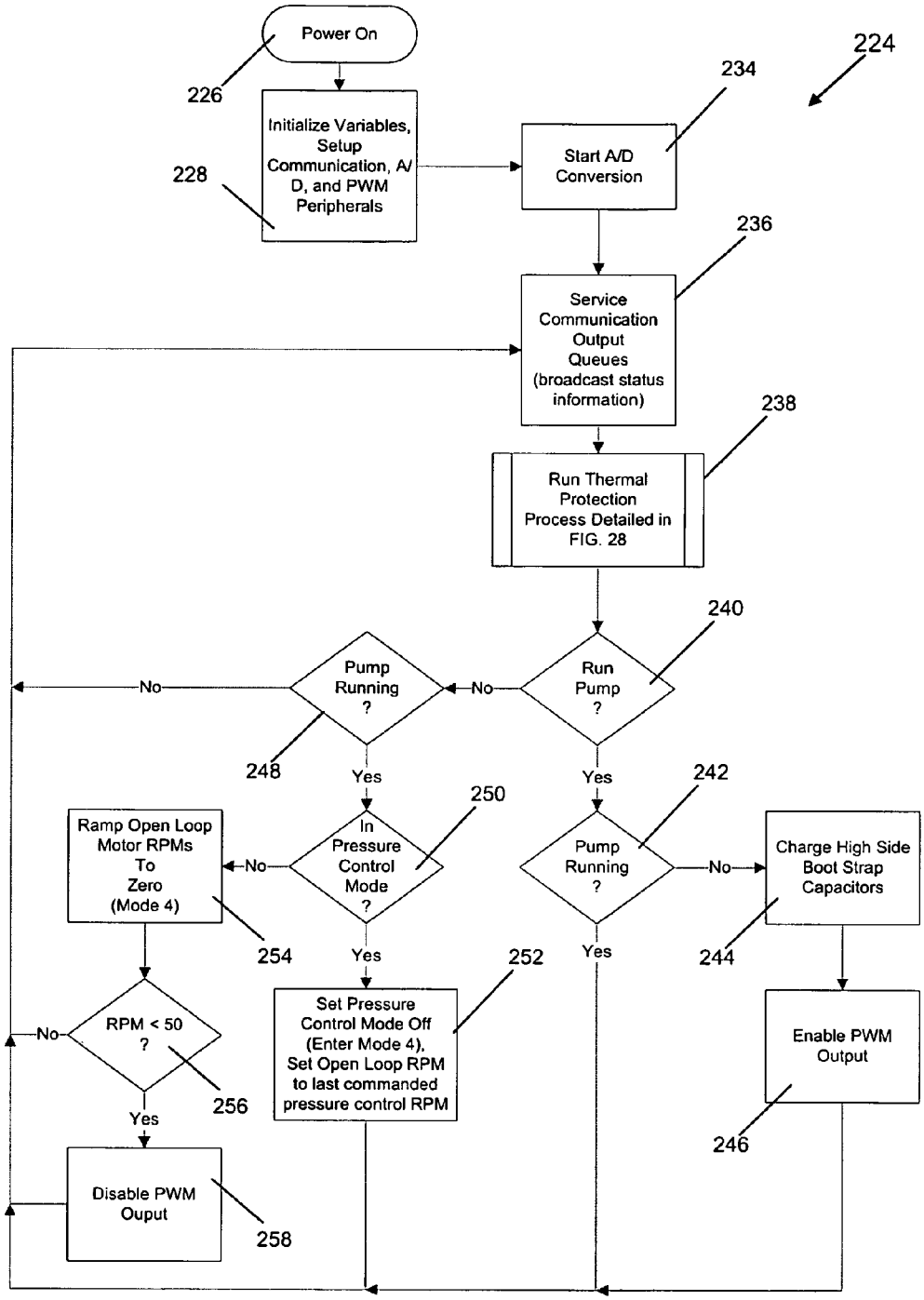
FIGS. 24 through 33 are flowchart views that detail an embodiment of a multi-mode control process of the fuel transfer pump system.

Referring to FIGS. 2 and 24, the multi-mode control process 222 comprises an outer lower priority control loop process or outer loop process 224.

FIG. 24 details the outer loop process 224 which defers to any higher priority interrupt which runs to completion wherein the outer loop process 224 picks back up where it left off when any higher priority interrupt occurs.

Figure 25:
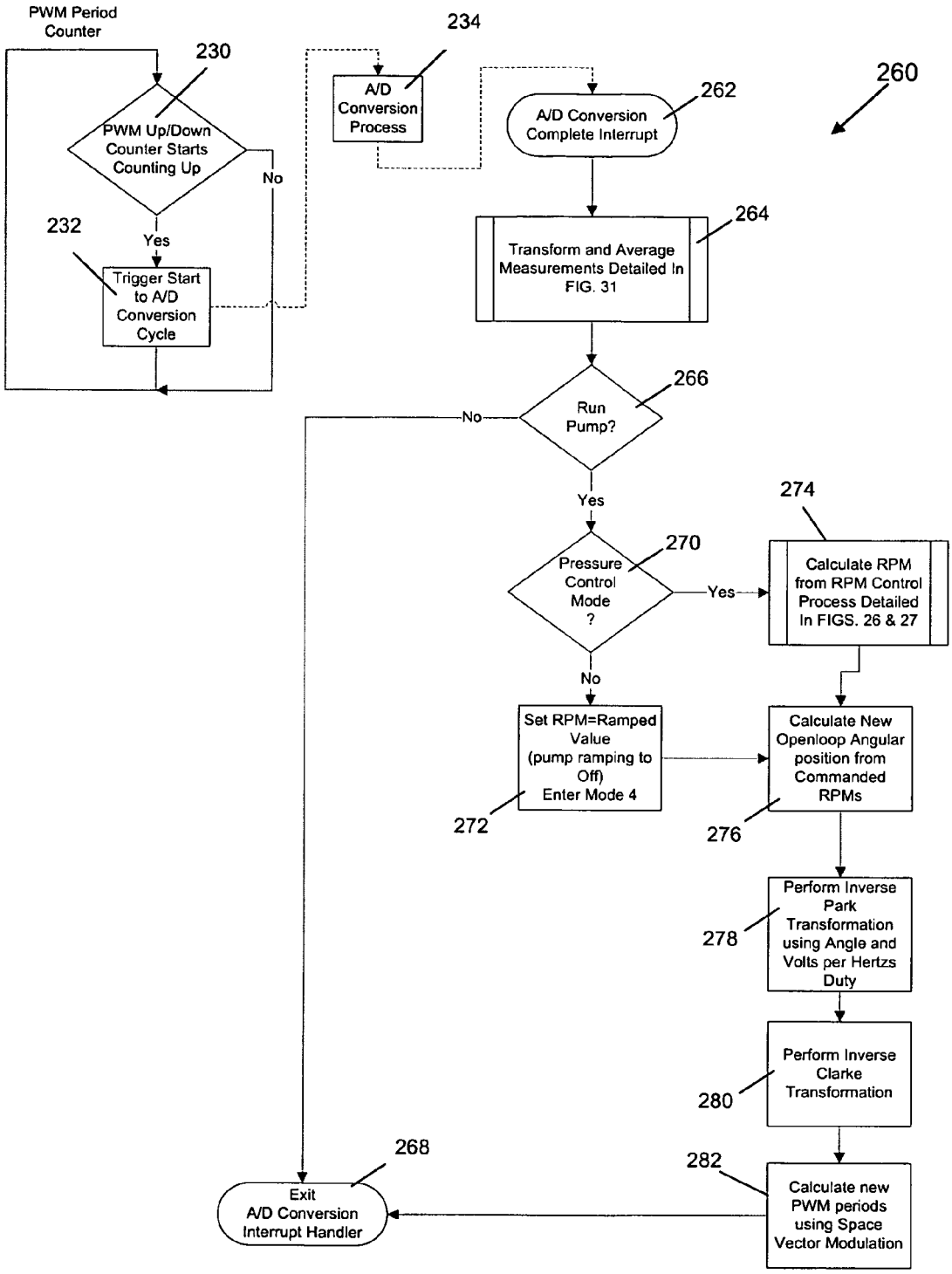

At the outset, the outer loop process 224 begins with a power on signal 226 initiated by, for example, starting of the engine 32 or perhaps by an engine prestart condition that actuates power on signal 226. Next, the process 224 flows to process block 228 for initializing initializes variables and setting up communication, A/D, and pulse width modulated peripherals. Then, process block starts an A/D conversion 234 via A/D converter 192 (FIG. 2) while the outer loop 224 continues. The A/D conversion occurs every PWM carrier frequency cycle for converting the outputs of the phase-A current transducer means 56 to IA, the phase-B current transducer means 58 to IB, the DC bus current transducer means 54 to IDC and for converting, via multiplexing, the outputs of the DC bus voltage transducer means 52 to VDC, the power transistor temperature sensing means 60 to MOSFET temperature 194, the MCU temperature sensing means 62 to MCU temperature 196, the fuel temperature sensing means 38 to fuel temperature 198, and the pressure transducer 36 to pressure 200 (FIG. 2). Upon completion of the A/D conversion 234, an A/D conversion complete interrupt process 260 occurs which is illustrated in FIG. 25 and delineated in detail below. The process flow of the outer loop 224 proceeds to process block 236 for servicing communication output queues and broadcasting status. Then, the outer loop 224 proceeds to process block 238 for running a thermal protection process 344 which is delineated in detail below and in FIG. 28. The thermal protection process is not an interrupt.

Then, the outer loop 224 proceeds to decision block 240 for determining if a run pump command has been given and, if yes, the process flow proceeds to decision block 242 for determining if the pump 14 is running and if yes, the pump is running, then the outer loop process 224 loops back to process block 236 and process flow continues. If no, the pump is not running, then the process flows to process block 244 for charging high side boot strap capacitors delineated above and shown in FIGS. 6 through 8 which is followed by process block 246 for enabling PWM output 220 (FIG. 3). Then, the outer loop process 224 loops back to process block 236 and process flow continues.

Alternatively, if the result of decision block 240 is no, then the process flows to decision block 248 for determining if the pump 14 is running and if no, the pump is not running, then the outer loop process 224 loops back to process block 236 and process flow continues. If yes, the pump is running, then the process flows to decision block 250 for determining if the multi-mode control process 222 is in a pressure control mode 272 and if yes, then at process block 252 the pressure control mode 272 (FIG. 2) is set to off and the multi-mode control process 222 enters ramp-down mode 302 utilizing an open loop RPM control 212 (FIG. 3) wherein the open loop RPM is set to a last commanded pressure control RPM and then, the outer loop process 224 loops back to process block 236 and process flow continues. The open loop RPM control 212 is delineated in further detail below. If the result of decision block 250 is no, then at process block 254 the ramp-down mode 302 utilizes the open loop RPM control 212 to ramp the RPM of the motor 16 to zero by utilizing a decision block 256 for determining if the RPM is less than fifty and if no, then the outer loop process 224 loops back to process block 236 and again through process block 254 and decision block 256 until the RPM is less than fifty thereby resulting in the process flowing to process block 258 for disabling the PWM output 220 (FIG. 2) then looping back to process block 236 wherein the process flow continues until power off.

A/D Conversion-Complete Interrupt Process

FIG. 25 illustrates a flowchart of the A/D conversion complete interrupt process 260 including an initial PWM period counter process for starting the A/D conversion process 234.

At the outset, the initial PWM period counter process starts with decision block 230 for determining if a PWM up/down counter 202 (FIG. 2) has started to count up and, if no, the decision loops upon itself and, if yes, then at process block 232 the start of the count up triggers the start to a conversion cycle for performing the A/D conversion process 234 as delineated in detail above.

Upon completion of the A/D conversion process 234, the A/D conversion complete interrupt process 260 begins at block 262 and proceeds to process block 264 for running a transform and average measurement process 416 detailed below and in FIG. 31 for transforming and averaging the measurements obtained during the A/D conversion process 234.

Next, the process proceeds to decision block 266 for determining if a run pump command has been given and, if no, then the process proceeds to exit the A/D conversion interrupt at block 268 and return to the outer lower priority control loop process 224 which resumes where it left off. If the result of decision block 266 is yes, then the process proceeds to decision block 270 for determining if the multi-mode control process 222 is in the pressure control mode 272 and, if no, then the process proceeds to process block 272 wherein the process enters ramp-down mode 302 utilizing the open loop RPM control 212 and, if the result is yes, then the process proceeds to a RPM control process 274 detailed below and in FIGS. 26 and 27 for calculating the RPM for defining a commanded RPM.

Next, the process proceeds to process block 276 for calculating a open loop angular position from the commanded RPM for determining how much angle does the rotor of the motor 16 need to traverse for a given amount of time (Δt) to achieve the commanded RPM. The RPM multiplied by At equals the angle and the time is fixed and determined by the carrier frequency of the system 10.

Still referring to FIG. 25 and back to FIG. 3, process 260 proceeds to process block 278 for performing an inverse Park transformation 216 by utilizing the above calculated angle, a volts per hertz duty (Vd) determined from a Volts/Hertz profile or process 214 (FIG. 2), and a value of zero for Vq. The Volts/Hertz duty profile or process 214 is delineated in detail below with reference to FIG. 32. Next, and with reference also to FIG. 3, the process proceeds to process block 280 for performing an inverse Clark transformation 217. Then, the process flows to process block 282 for performing, with reference also to FIG. 3, a space vector modulation process 218 utilized for calculating PWM periods 220 for driving the 3-phase inverter bridge circuit 42 and, in turn, motor 16. In other words, the SVM takes the desired/commanded stator referenced voltages and calculates the PWM period for each phase.

Then, process 260 proceeds to exit the A/D conversion interrupt at block 268 and the outer lower priority control loop process 224 resumes where it left off.

RPM Control Process

Figure 26:
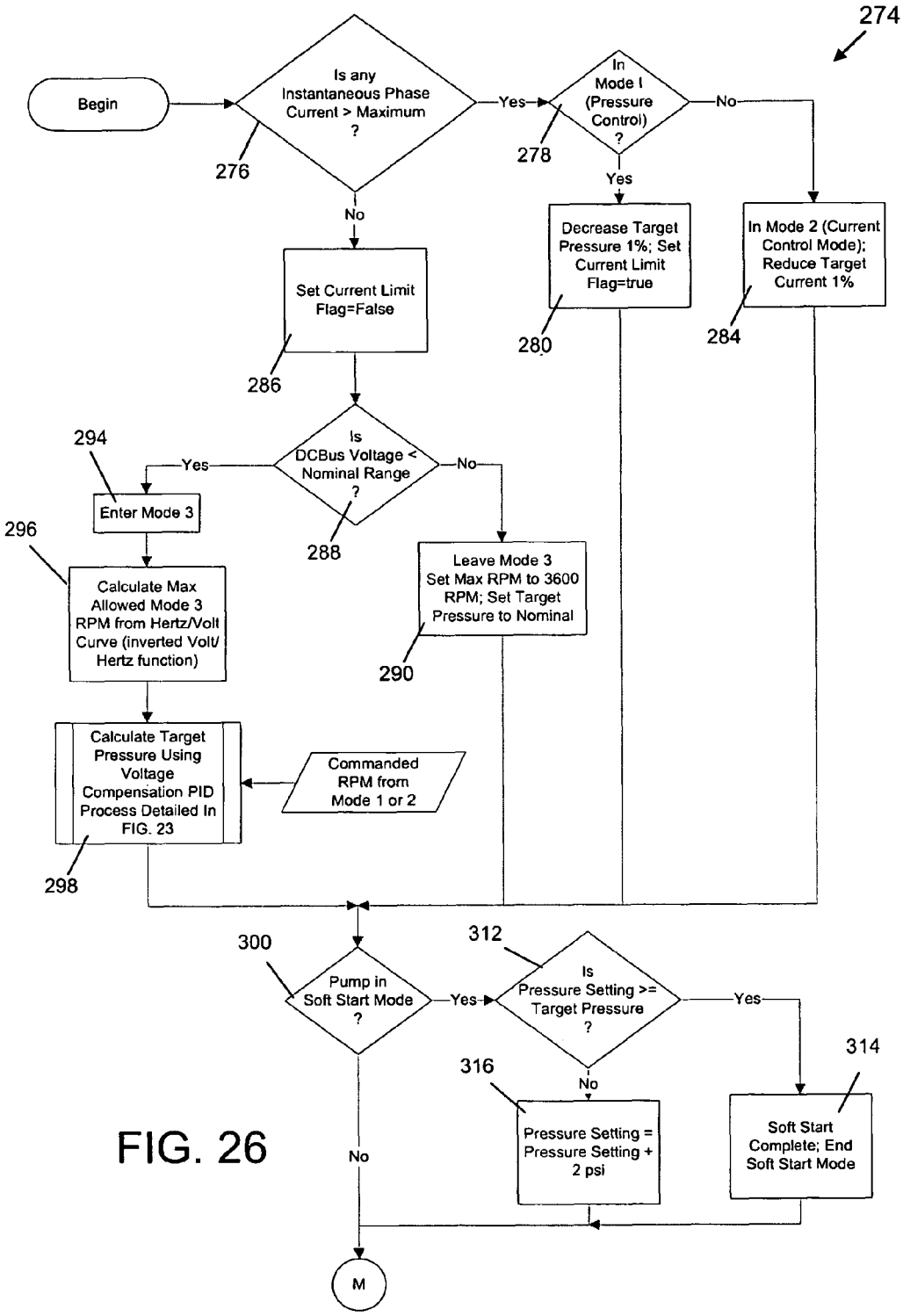
Figure 27:
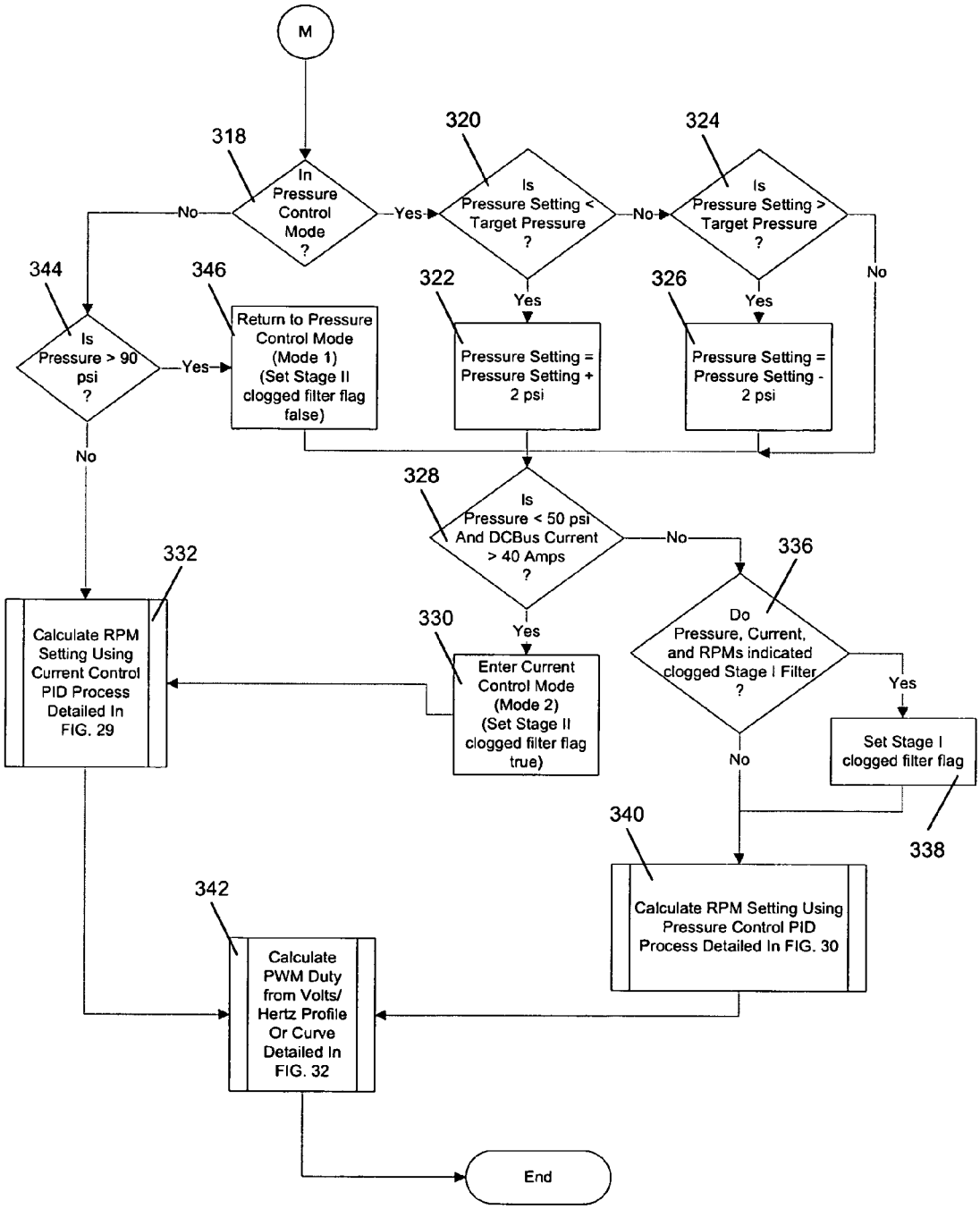

FIGS. 26 and 27 combine to form a flowchart of the above noted RPM control process 274 of the multi-mode control process 222.

Figure 36:
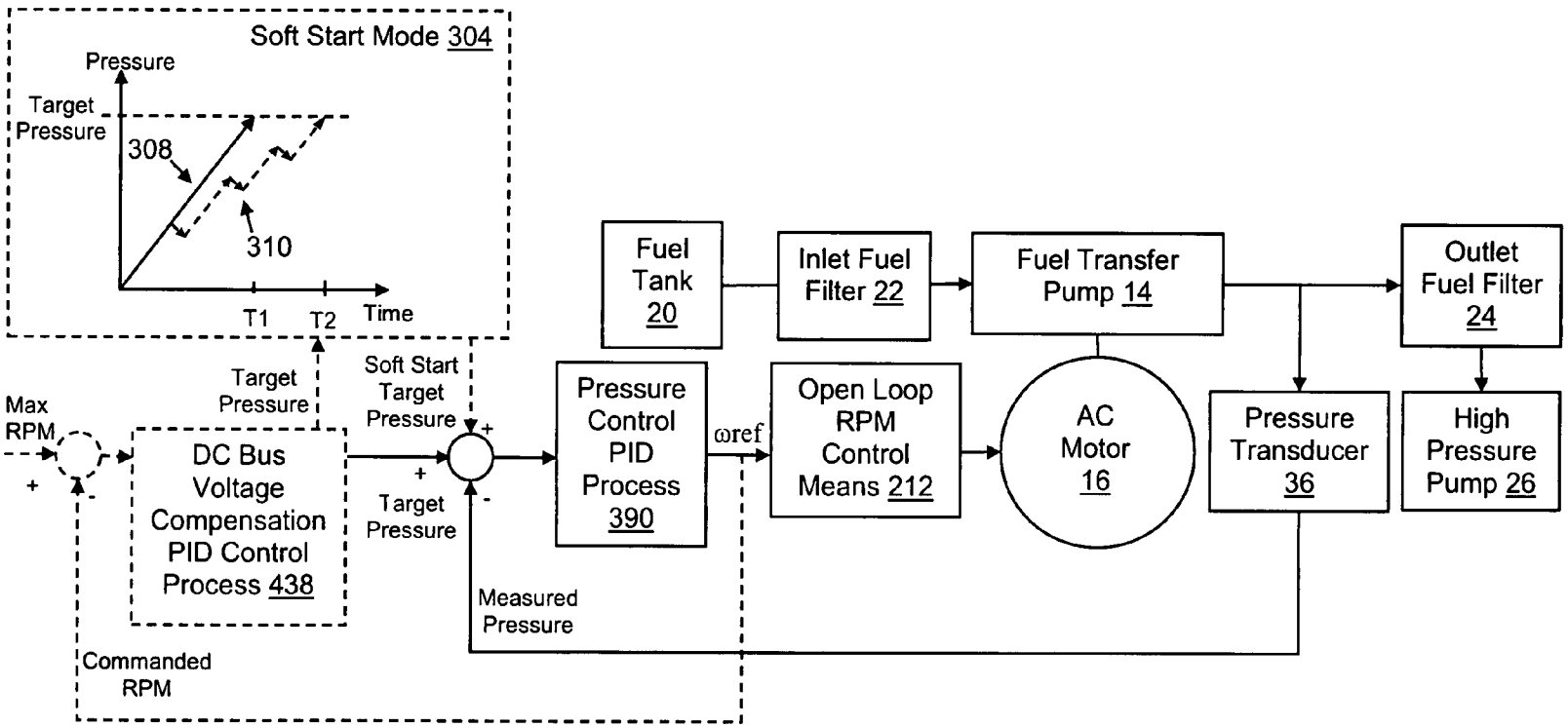
FIG. 36 is a diagrammatic view of an embodiment of a soft start mode, a closed loop pressure control mode, and a DC bus Voltage Compensation control mode of the multi-mode control process of the fuel transfer pump system.

Referring to FIG. 26, and after commencing, the RPM control process 274 makes a decision at decision block 276 for determining if any instantaneous phase current (IA or IB in FIG. 2) is greater than a predefined maximum which is a function of the motor 16 being employed. If the result of decision block 276 is yes, then decision block 278 determines if the multi-mode control process 222 is in pressure control mode 272 (Mode 1) and, if this result is yes, then the target pressure is decreased by a predetermined percent such as one percent and the current limit flag is set to true at process block 280 and, if this result is no, then at process block 284 the multi-mode control process 222 is determined to be in current control mode 282 (Mode 2) illustrated in FIG. 2 and the target current is decreased by a predetermined percent such as one percent. After either process 280 or 284, the process flow is passed to decision block 300 for determining if multi-mode control process 222 is in a soft start mode 304 (FIGS. 2 and 36).

Alternatively, if the result of the decision block 276 is no, then a current limit flag is set to false at process blck 286. Then a decision is made at decision block 288 for determining if the DC bus voltage, VDC in FIG. 2, is less than a predefined value or a nominal range and, if the result is no, then the multi-mode control process 222 leaves a DC Voltage Compensation Mode 292 (Mode 3) illustrated in FIG. 2 and sets the maximum RPM to 3600 and the target pressure to a predefined nominal value at process block 290. The process flow is then passed to the above noted decision block 300 for determining if the pump is in the soft start mode 304. Alternatively, if the result to decision block 288 is yes, then the DC Voltage Compensation Mode 292 (Mode 3) is entered at process block 294. Following entry of Mode 3, process block 296 calculates a maximum allowed Mode 3 RPM from a HertzNolt profile or curve which is an inverse of the Volt/Hertz profile or curve 214. Then process flow is to process block 298 wherein a target pressure is calculated by utilizing a voltage compensation PID process 438 which employs a commanded RPM from Mode 1 or 2 and which is delineated in detail below and in FIG. 33.

Then, process flow is then passed to the above noted decision block 300 for determining if the pump is in the soft start mode 304. If the result of decision block 300 is yes, then the process flows to decision block 312 for determining if the pressure setting (the instantaneous pressure that the pump maintains) is greater than or equal to the target pressure (the pressure that the pump is desired to achieve or controlled to). If the result of decision block 312 is yes, then process block 314 makes a determination that the soft start mode 304 is complete and ends the soft start mode of operation of the motor 16 and, if the result of decision block 312 is no, then the pressure setting is raised by a predetermined amount which, in one embodiment, is two psi. After either process block 314 or 316, or if the result of decision block 300 is no, the process flow is to a decision block 318 in FIG. 27 for determining if the pump is in a pressure control mode 272.

Referring now to FIG. 27, while continuing to refer to FIG. 26, if the result of decision block 318 is yes or, in other words, if it is determined that the multi-mode control process 222 is in pressure control mode 272, then the process flows to decision block 320 for determining if the pressure setting (the instantaneous pressure that the pump maintains) is less than the target pressure (the pressure that the pump is desired to achieve). If the result of decision block 320 is yes, then at process block 322 the pressure setting is increased by a predetermined amount which, in one embodiment, is two psi and then the process flows to decision block 328 for determining if the pressure 200 measured from the pressure transducer 36 is less than a predetermined amount which, in one embodiment, is 50 psi and if the DC bus current (IDC) is greater than a predetermined amount which, in one embodinient, is 40 Amps.

Alternatively, if the result of decision block 320 is no, then the process flows to decision block 324 for determining if the pressure setting (the instantaneous pressure that the pump maintains) is greater than the target pressure (the pressure that the pump is desired to achieve). If the result of decision block 324 is yes, then at process block 326 the pressure setting is decreased by a predetermined amount which, in one embodiment, is two psi and then the process flows to the above noted decision block 328. If the result of decision block 324 is no, then the process flows to the above noted decision block 328.

Figure 29:
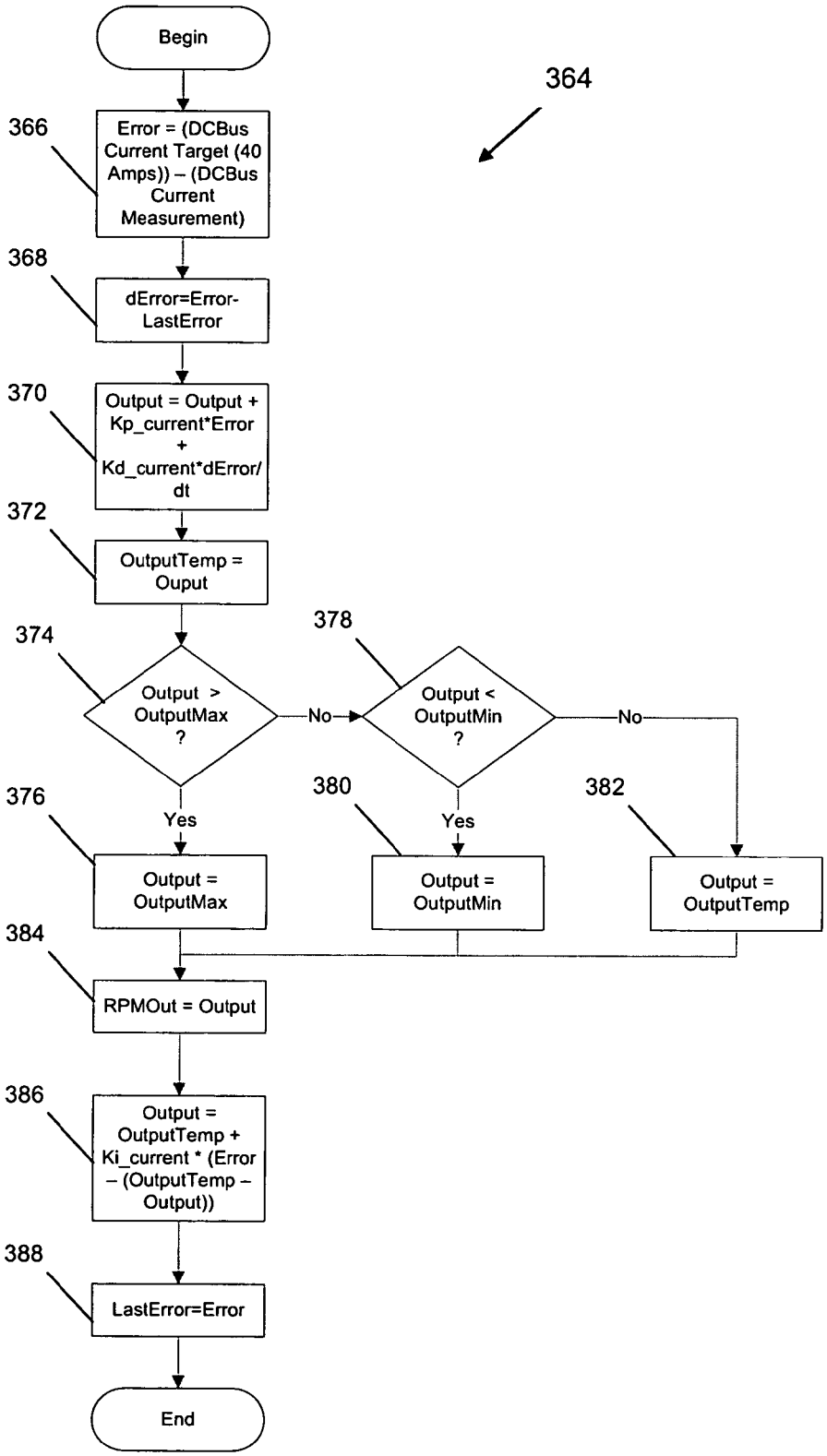

With the pressure setting increased, decreased, or unchanged, decision block 328 determines if the pressure measured from the pressure transducer 36 is less than the predetermined amount and if the DC bus current is greater than the predetermined amount. If the result of decision block 328 is yes, then the multi-mode control process 222 enters the current control mode 282 (Mode 2 ) and a Stage II clogged filter flag is set to true and a status flag may be sent to the ECU for causing an actuation of a visual and/or audio indication 334 (FIG. 1) correlative to a Stage II clogged filter for notifying an operator of the vehicle. From there, the process flows to process branch 332 for calculating the RPM setting which becomes the commanded RPM by utilizing a current control PID process 364. The current control PID process 364 is illustrated in FIG. 29 and is delineated in detail below.

With the RPM calculated from the current control PID process 364, the process flows to process block 342 for calculating a PWM duty utilizing the Volts/Hertz Curve or profile 214 detailed below and in FIG. 32. The RPM control process 274 ends after process block 342.

Alternatively if the results of decision block 328 is no, then a subsequent decision is made at decision block 336 for determining if the pressure measurements, current measurements, and RPMs are correlative to calculated or empirically determined values that are representative of a clogged Stage I filter. If the result of decision block 336 is yes, then a Stage I clogged filter flag is set to true and the visual and/or audio indication 334 (FIG. 1) correlative to a Stage I clogged filter is actuated and presented to an operator of the vehicle. The process flows to process block 340 from process block 338 and if the result of decision block 336 is no.

Figure 30:
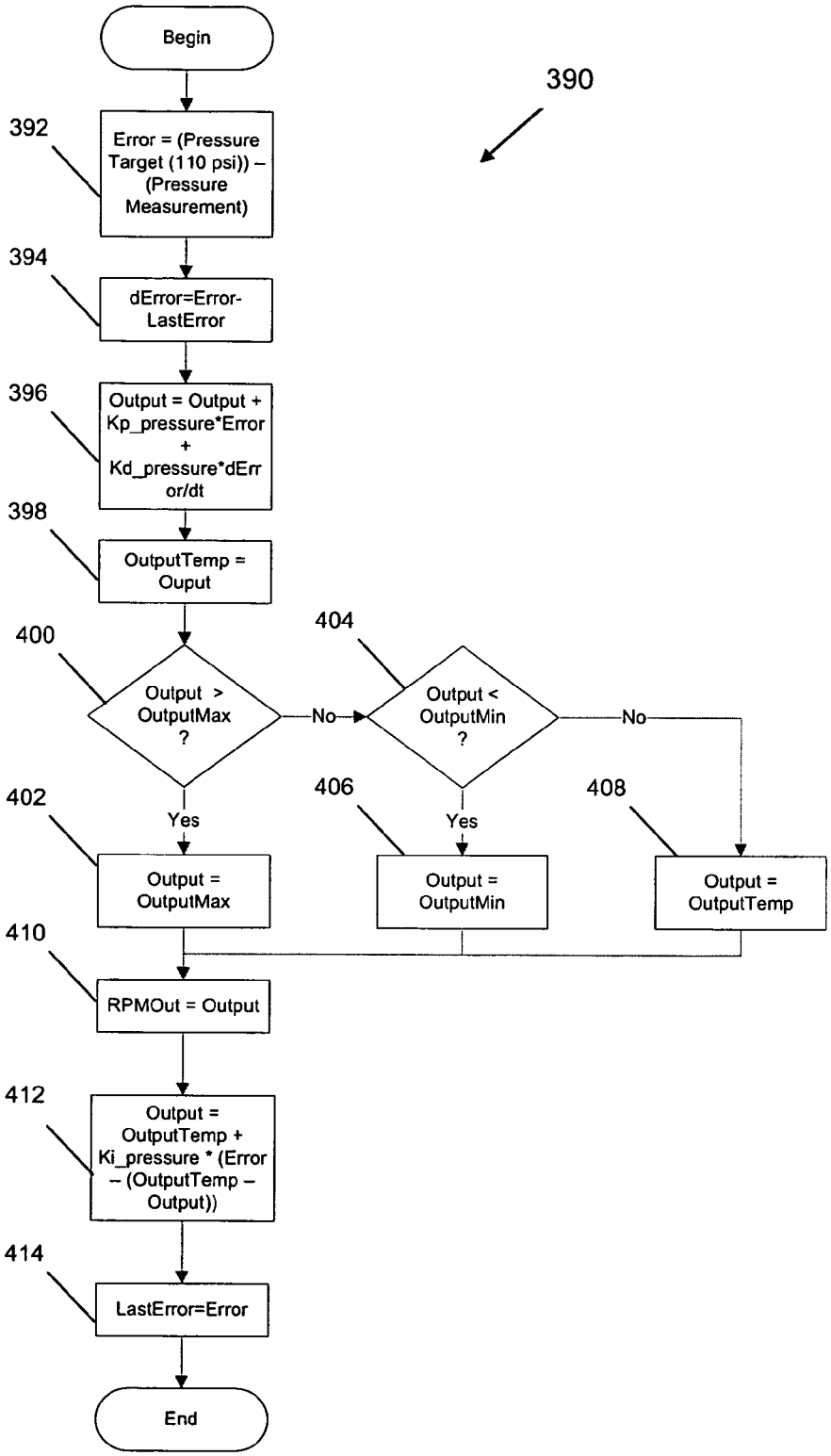

Process block 340 utilizes the pressure control PID process 390 detailed in FIG. 30 for calculating a RPM setting which becomes the commanded RPM. With the RPM calculated, the process flows to process block 342 for calculating a PWM duty utilizing the Volts/Hertz Curve or profile 214 detailed below and in FIG. 32. The RPM control process 274 ends after process block 342.

Now, if the result of decision block 318 is no, then the process flows to decision block 344 for determining if the pressure measured by the pressure transducer is greater than a predefined threshold which, in one embodiment, is 90 psi. If the result of decision block 344 is no, then the process flows to process block 332 and 342 which have been delineated in detail above and the RPM control process 274 ends after process block 342.

Alternatively if the result of decision block 344 is yes, then the process flows to process block 346 for returning the multi-mode control process 222 to the pressure control mode 272 (Mode 1) and setting the Stage II clogged filter flag to false. From process block 346, the process flows to decision block 328 from which the process flows as delineated in detail above until ending after process block 342.

Thermal Protection Process

Figure 28:
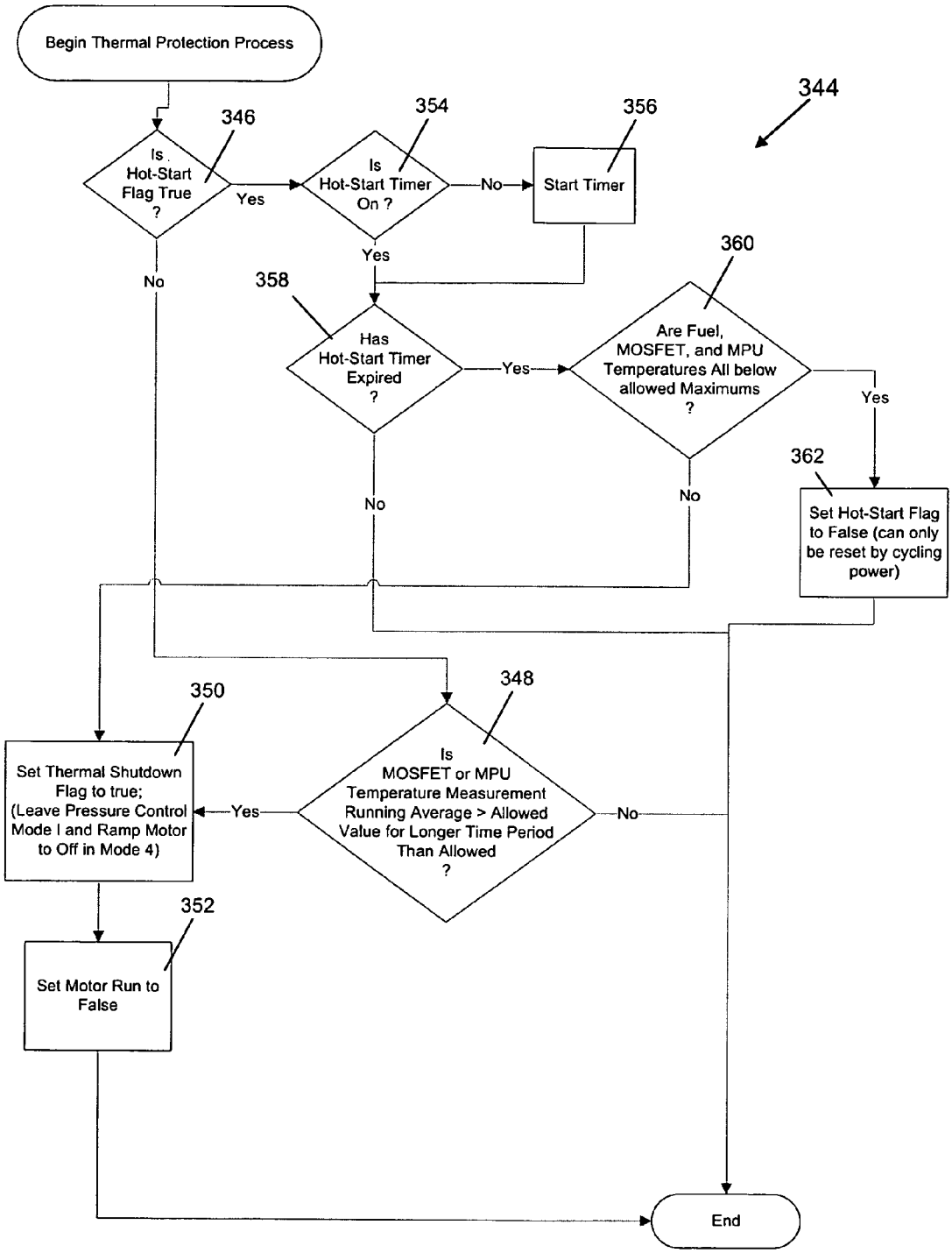

FIG. 28 illustrates a detailed flowchart of one embodiment of the thermal protection process 344 ran at process block 238 in FIG. 24. The thermal protection process 344 commences with a decision block 346 for determining if a hot start flag is set to true which reflects that the fuel temperature, as measured by the fuel temperature sensing means 38, is greater than a predetermined allowed value which, in one embodiment, is about 70 degrees Celsius. If the result of decision block 346 is no, then the thermal protection process 344 flows to decision block 348 for determining if a temperature measurement running average of the MOSFETs of the 3-phase inverter bride circuit 42 or of the Microcontroller 40, as respectively measured by the power transistor temperature sensing means 60 and the MCU temperature sensing means 62, is greater than a respective allowed value for longer than a predetermined allowed time period. In one embodiment, the allowed value for the power transistor temperature (MOSFET Temp 194) and the MCU (MCU Temp 196) are both about 90 degrees Celsius. If the answer to decision block 348 is no, then the thermal protection process 344 ends. Alternatively, if the answer to decision block 348 is yes, then the process flows to process block 350 for setting a thermal shutdown flag to true and for exiting the pressure control mode 272 (Mode 1) and then, entering the ramp-down mode 302 (Mode 4) for ramping the motor 16 to off. Process block 350 is followed by process block 352 for setting a motor run flag to false which, in turn, is followed by the end of the thermal protection process 344.

Referring back up to decision block 346, if the answer to decision block 346 is yes, then the process flows to decision block 354 for determining if a hot-start timer is on and, if the answer to decision block 354 is yes, then the process flow is to decision block 358 for determining if the hot-start timer has expired and, if the answer to decision block 354 is no, the process flow is first to a process block 356 for starting the hot-start timer and then to decision block 358. Decision block 358 determines if the hot start timer has expired and, if no, then the tliermal protection process 344 ends and, if yes, then the process flows to decision block 360 for determining if the fuel temperature 198, the MOSFET temperature 194, and the Microcontroller temperature 196 are all below predetermined allowed maximums. If the answer to decision block 360 is yes, then the process flows to process block 362 for setting the hot-start flag to false wherein the hot- start flag can only be reset by cycling power and wherein setting the hot-start flag to false is followed by the end of the thermal protection process 344. Alternatively, if the answer to decision block 360 is no, then the process flows to process block 350 followed by process block 352 which, in turn, is followed by the end of the thermal protection process 344 as delineated above.

Current Control PID Process

FIG. 29 illustrates a detailed flowchart of one embodiment of the current control PID process 364 for calculating an output in the form of an output RPM setting which becomes the commanded RPM and which is defined below as RPM Out by utilizing the DC bus current target or set point which, in one embodiment, is 40 amps and the DC bus current measurement (IDC) as inputs to the current control PID process 364.

The current control PID process 364 commences with process block 366 for calculating an error which is the DC bus current target (e.g., 40 amps) minus the DC bus current measurement (IDC). Then the process 364 flows to process block 368 for determining a delta error or difference which is equal to the error minus the last error calculated. Next, the process flows to process block 370 for calculating an output that is equal to the last output stored plus a predefined proportional coefficient times the current error plus a predefined derivative coefficient times a delta error divided by a delta time where delta time is constant because the system 10 is utilizing a fixed frequency. Then the process flows to process block 372 for storing the output calculated in process block 370 as Output Temp.

Next, the process flows to decision block 374 for determining if the output is greater than a predefined output maximum and if yes, then output is defined as the output maximum at process block 376. If no, decision block 378 determines if the output is less than a predefined output minimum. If the result of decision block 378 is yes, then the output is defined as the output minimum at process block 380 and, if no, then the output is defined at process block 382 as the previously stored output in process block 372. Then, one of these three outputs is passed to process block 384 for defining the RPM Out. Next, error is accumulated at process block 386 by setting the output to the Output Temp value plus a predefined integral coefficient times the value obtained by taking the difference between the error and the Output Temp value minus the output value. Finally, process block 388 stores the error obtained at process block 386 as the last error and the current control PID process 364 ends.

Pressure Control PID Process

FIG. 30 illustrates a detailed flowchart of one embodiment of the pressure control HD process 390 for calculating an output in the form of an output RPM setting which becomes the commanded RPM and which is defined below as RPM Out by utilizing the pressure target or target pressure which, in one embodiment, is 110 psi and the pressure measurement 200 obtained by the pressure transducer 36 as inputs to the pressure control PID process 390.

The pressure control PID process 390 commences with process block 392 for calculating an error which is the pressure target (e.g., 110 psi) minus the pressure measurement 200. Then the process flows to process block 394 for determining a delta error or difference which is equal to the error minus the last error calculated. Next, the process flows to process block 396 for calculating an output that is equal to the last output stored plus a predefined proportional coefficient times the current error plus a predefined derivative coefficient times a delta error divided by a delta time where delta time is constant because the system 10 is utilizing a fixed frequency. Then the process flows to process block 398 for storing the output calculated in process 396 as Output Temp.

Next, the process flows to decision block 400 for determining if the output is greater than a predefined output maximum and if yes, then output is defined as the output maximum at process block 402. If no, decision block 404 determines if the output is less than a predefined output minimum. If the result of decision block 404 is yes, then the output is defined as the output minimum at process block 406 and, if no, then the output is defined at process block 408 as the previously stored output in process block 398. Then, one of these three outputs is passed to process block 410 for defining the RPM Out. Next, error is accumulated at process block 412 by setting the output to the Output Temp value plus a predefined integral coefficient times the value obtained by taking the difference between the error and the Output Temp value minus the output value. Finally, process block 414 stores the error obtained at block 412 as the last error and the pressure control PID process 390 ends.

Transform and Average Measurements Process

Figure 31:
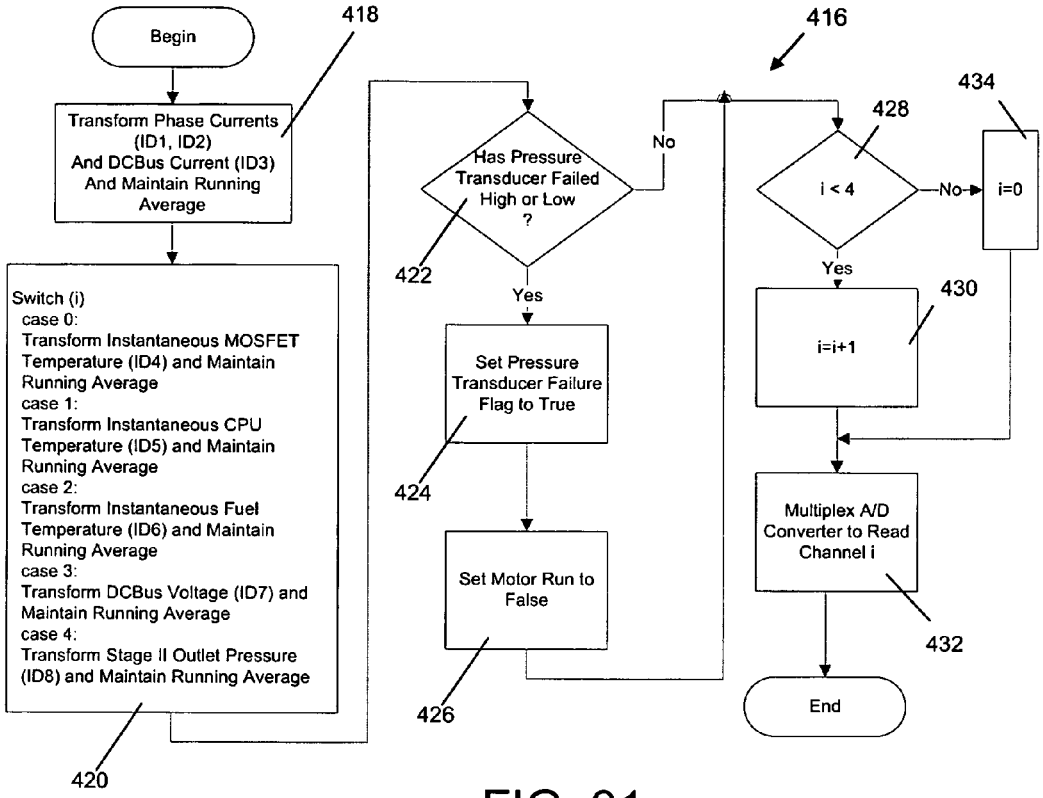

FIG. 31 illustrates a detailed flowchart of one embodiment of the transform and average measurement process 416 ran at process block 264 in FIG. 25. The transform and average measurement process 416 commences with a process block 418 for transforming phase currents IA and IB, also referred to as ID1 and ID2, and the DC bus current IDC, also referred to as ID3, by utilizing three channels of the A/D converter 192 (FIG. 2) and maintaining a running average of the transformations. A running average is a simple 64 member moving window running average using the algorithm average =average−1/64*measurement (i−63)+1/64*measurement (i). Next, the fourth channel of the A/D converter is multiplexed and process block 420 transforms and maintains a running average of one of the five cases (cases 0 through 4) for each cycle starting with case zero and incrementing the case number for each cycle. The five cases that process block 420 transforms and maintains a running average are comprised of the MOSFET temperature 194 (ID4), the Microcontroller temperature 196 (ID5), the Fuel temperature 198 (ID6), the DC bus voltage IDC (ID7), and the transducer pressure 200 (ID8).

After process block 420, the process flows to decision block 422 for determining if the pressure transducer 36 has failed high or low and, if yes, then continues to process block 424 for setting a pressure failure flag to true followed by continuing to process block 426 for setting the motor run flag to false and then to decision block 428. Alternatively, if the answer to decision block 422 is no, then the process proceeds directly to decision block 428. Decision block 428 determines if the case number is less than four and, if yes, the index (i) is incremented by one at process block 430 which is followed by process block 432 multiplexed to read channel (i) or, in other words the next channel so that the next case will be read on the next cycle of the transform and average measurement process 416. Process block 432 is followed by the end of one cycle of the transform and average measurement process 416.

Alternatively, if the result of decision block 428 is no, then the process flow is to process block 434 for resetting (i) to zero as a result of (i) being incremented by 1 for each cycle from zero to four wherein on the first cycle (i)=3, on the second cycle (i)=1, on the third cycle (i)=2, on the fourth cycle (i)=3, and on the fifth cycle (i)=4 and is then reset to zero. Thus, the transform and average measurement process 416 is performed on cases zero through four. After process block 434, the process flow is to process block 432 followed by the end of one cycle of the transform and average measurement process 416 as delineated above.

Calculate PWM Duty From Volts/Hertz Curve Process

Figure 32:
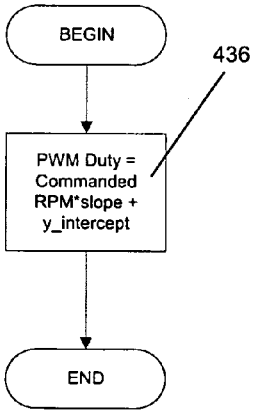

FIG. 32 illustrates a flowchart of one embodiment of a calculate PWM duty from Volts/Hertz profile or curve process 436 wherein the process is comprised of multiplying the commanded RPM by the slope of the Volts/Hertz profile or curve and adding thereto the Y-intercept of the Volts/Hertz profile or curve or, in other words, the PWM Duty=Commanded RPM*slope+Y intercept.

DC Bus Voltage Compensation PID Control Process

Figure 33:
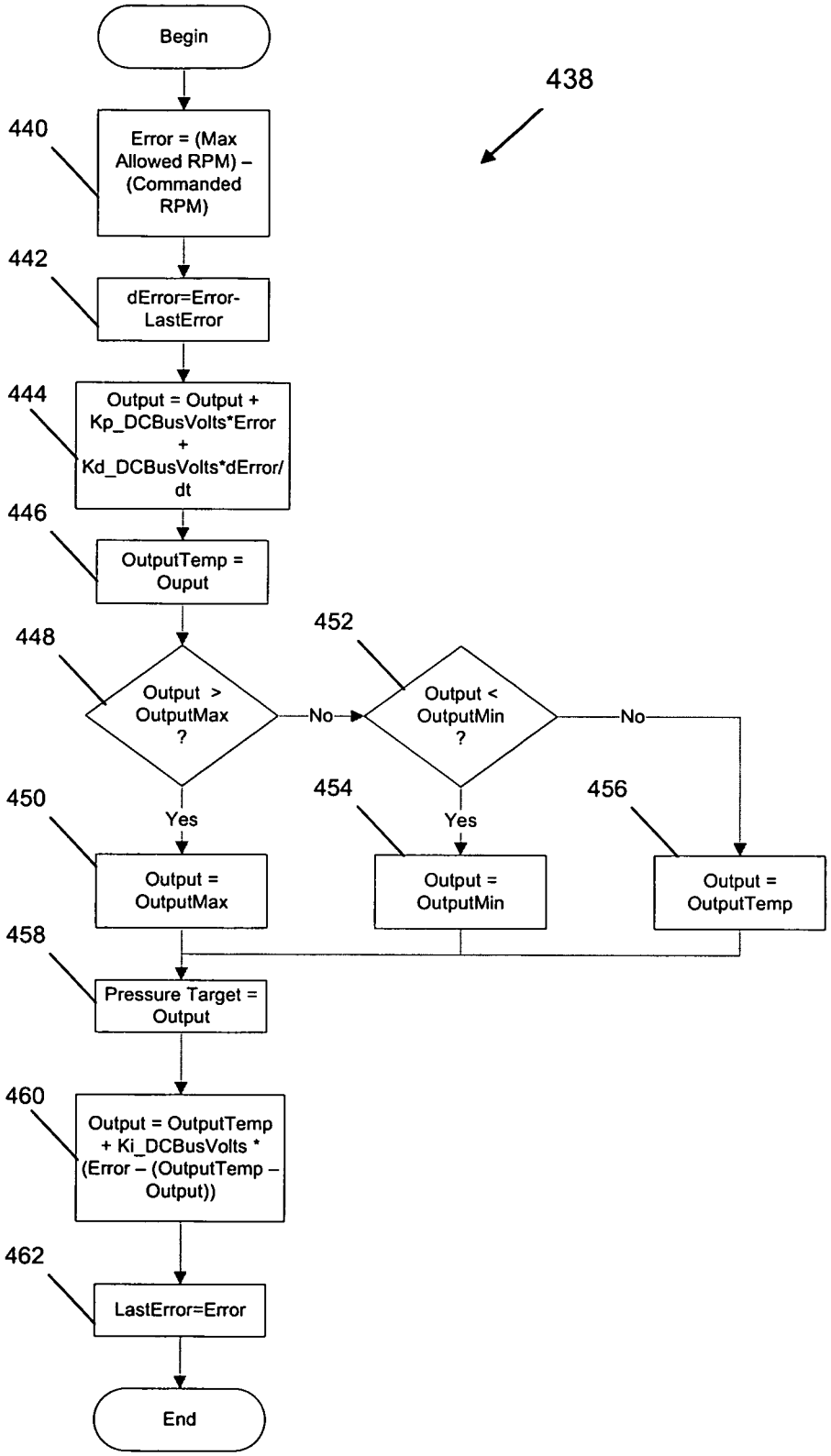

FIG. 33 illustrates a detailed flowchart of one embodiment of the DC bus Voltage Compensation PID control process 438 for calculating an output in the form of a target pressure which becomes the target pressure as a function of a DC bus voltage sag and which is defined below as pressure target by utilizing a maximum allowed RPM for a given DC bus voltage and a commanded RPM as inputs to the DC bus Voltage Compensation PID control process 438. The DC bus Voltage Compensation PID control process 438 is ran at process block 298 in FIG. 26.

The DC bus Voltage Compensation PID control process 438 commences with process block 440 for calculating an error which is the maximum allowed RPM for a given DC bus voltage minus the commanded RPM. Then the process flows to process block 442 for determining a delta error or difference which is equal to the error minus the last error calculated. Next, the process flows to process block 444 for calculating an output that is equal to the last output stored plus a predefined proportional coefficient times the current error plus a predefined derivative coefficient times a delta error divided by a delta time where delta time is constant because the system 10 is utilizing a fixed frequency. Then the process flows to process block 446 for storing the output calculated in process block 444 as Output Temp. Next, the process flows to decision block 448 for determining if the output is greater than a predefined output maximum and if yes, then output is defined as the output maximum at process block 450. If no, decision block 452 determines if the output is less than a predefined output minimum. If the result of decision block 452 is yes, then the output is defined as the output minimum at process block 454 and, if no, then the output is defined at process block 456 as the previously stored output in process block 446. Then, one of these three outputs is passed to process block 458 for defining the Pressure target or target pressure. Next, error is accumulated at process block 460 by setting the output to the Output Temp value plus a predefined integral coefficient times the value obtained by taking the difference between the error and the Output Temp value minus the output value. Finally, process block 462 stores the error obtained at block 460 as the last error and the DC bus Voltage Compensation PID control process 438 ends.

Fuel Transfer Pump Apparatus Configuration

Figure 34:
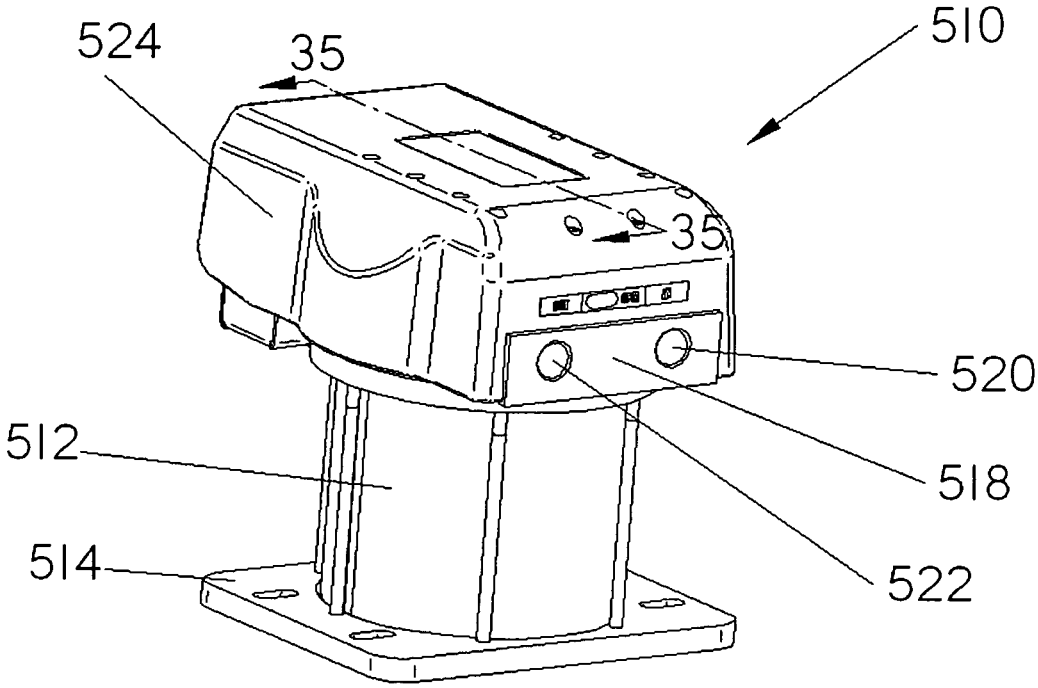
FIG. 34 is a perspective view of an embodiment of a fuel transfer pump assembly incorporating the fuel transfer pump system therein.

The fuel transfer pump system 10 can be packaged as one or more individual pieces or in a form of, but not limited to, a one piece motor-pump-control assembly as depicted by fuel transfer pump 510 illustrated in FIG. 34. In this example configuration, the AC motor 16 comprises a housing 512 having a base 514 at one end and a top plate 516 (FIG. 35) at the other end, the fuel transfer pump 14 comprises a pump body 518 surmounting the housing 512 and comprising an inlet port 520 and an outlet port 522, and a cap 524 housing the controller 18 and surmounting the pump body 518.

Figure 35:
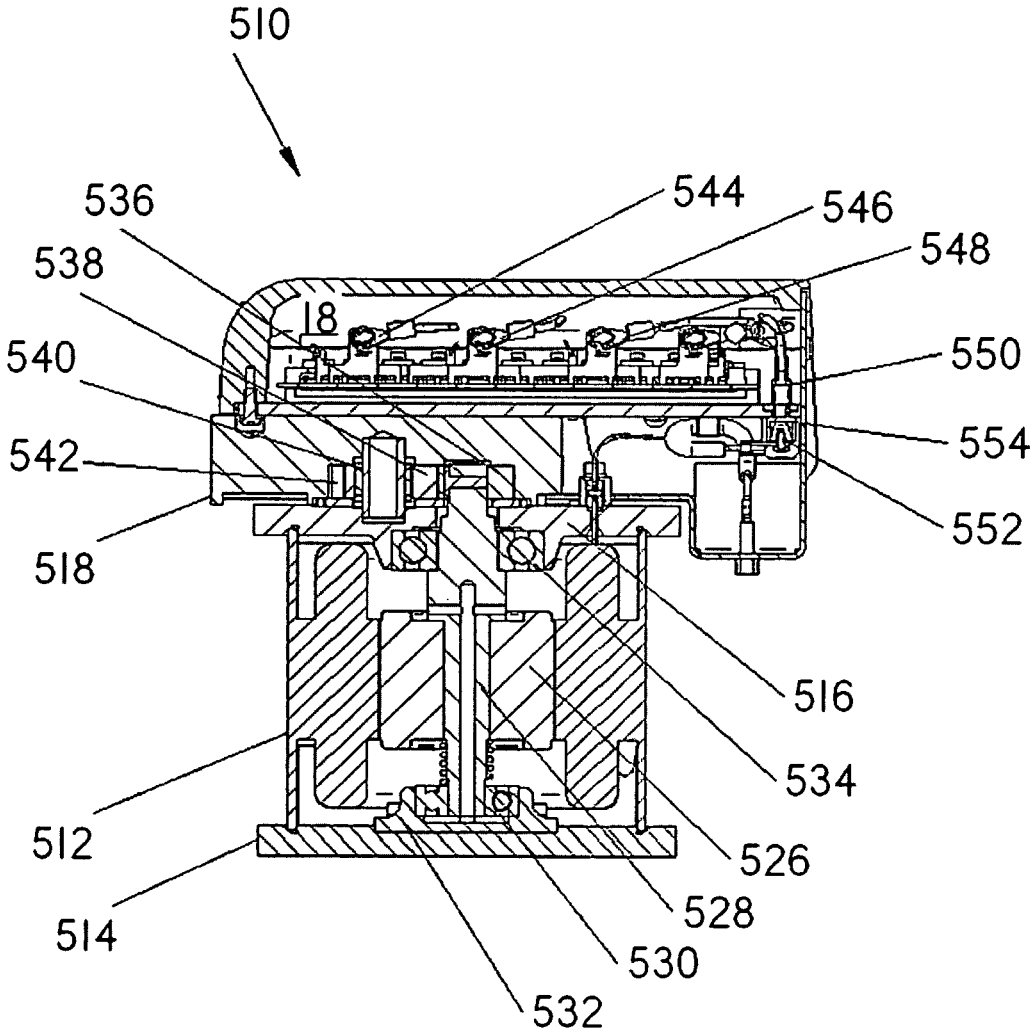
FIG. 35 is a side cutaway view along line 35-35 in FIG. 34.

Referring now to FIG. 35, the rotor 526 of the motor 16 is mounted vertically in the motor housing motor 512 and comprises a shaft 528 having a bearing 530 at a lower end which is mounted in a bearing support 532 fitted into the base 514 of the housing 512 and another bearing 534 at an opposing upper end of the shaft 528 which is mounted in the top plate 516. The upper end of the shaft 528 extends through the top plate 516 and into the pump body 518 where it fitted with a drive gear 536 that mates with a driven gear 538 that is mounted on a shaft 540 attached to the pump body 518 wherein the pump body 518 includes cavity 542 which together with counter rotating gears 536 and 538, comprise a gear pump which operates to deliver pressurized fuel to the high pressure pump 26 under control of system 10. Briefly, fuel is drawn from the fuel tank 20 through the inlet port 520 and into cavity 542, where it is pressurized and transported by counter rotating gears 536 and 538 to the outlet port 522. Electrical connectors 544, 546, and 548 connect the 3-phase inverter bridge circuit 42 of the controller 18 to the motor 16 and terminals 550 connect the DC bus to a connection block 554 which, in turn, is connected to the power source 12 via terminals 552.

In one embodiment, the fuel circulates through passages in the motor housing 512 for providing cooling and the controller 18 is mounted to the pump body 518 and relies on the fuel for heat removal.

In Use and Operation

In use and operation, and referring to the drawings, one embodiment of the fuel transfer pump system 10 is utilized on medium and large horsepower diesel engines. The fuel transfer pump system 10 delivers fuel from the fuel tank 20 to the high pressure fuel injection pump at, but not limited to, about 0 to about 120 psi, with a variable flow rate from about 0 to about 12 gallons per minute. Input voltage to the system 10 is either, but not limited to, 24 or 74 volts DC. The fuel transfer pump 14 is, but not limited to, an external gear pump, driven by the AC induction motor 16. Varies motor sizes such as a one-half or a three-quarter horsepower motor serve as size examples of the AC induction motor 16. In particular, a stator and a rotor for the one-half horsepower motor are supplied BALDOR under rerspective parts numbers 34L481S546G1S and 34L482S546G1R.

Additionally, and in use and operation, the fuel transfer pump system 10 comprises the multi-mode control process 222 which, in one embodiment, is comprised of the pressure control mode 272 (Mode 1) including soft start up mode 304; the current control mode 282 (Mode 2); the DC-bus voltage compensation mode 292 (Mode 3); and the open loop ramp down mode 302 (Mode 4) for ramping open loop motor RPMs to zero from any of the other control modes of operation.

FIG. 36 is a diagrammatic view of an embodiment of the soft start mode 304, the DC bus Voltage Compensation control mode 292, and the closed loop pressure control mode 272 of the multi-mode control process of the fuel transfer pump system.

The pressure control mode 272 (Mode 1) is a closed loop pressure control mode for maintaining the fuel pressure at the outlet of the fuel transfer pump 14 at a substantially constant target pressure. The fuel transfer pump system 10 maintains the target pressure at the high pressure fuel injection pump 26 inlet by varying the RPM of AC motor 16 which, in turn varies the RPM of the pump 14 for varying the fuel flow rate for maintaining the target pressure. The feedback information about outlet fuel pressure is provided by the pressure transducer 36 which is utilized by the pressure control PID process 390 for reiteratively calculating the difference (error) between the target pressure (pressure that is to be maintained substantially constant) and the measured pressured and transforming this difference into a commanded RPM that is provided to the open loop RPM control means 212 for controlling the AC motor 16 for driving the pump 14 for controlling the flow rate of fuel for obtaining the target pressure.

At start up, the fuel transfer pump system 10 utilizes the soft start mode 304 to minimize current inrush during the initial motor start up and also to eliminate voltage sag on the power source 12. The soft start mode 304 provides the means for bidirectionally ramping up to the target pressure by utilizing a soft start profile 306 in combination with the closed loop pressure control mode 272. The soft start profile 306 is illustrated in FIG. 36 as a positively sloped ramping function 308 and a negatively sloped ramping function 310. The soft start profile 306 is typically motor specific which can be empirically determined by an iterative process determining how fast the motor can build up pressure without having current getting larger that a predefined value. Thus, the soft start profile 306 provides an empirically determined positive and negative slope that is specific to the motor that is being driven. Along with the soft start profile 306, the system 10 utilizes the current limiting process so that the soft start profile 306 is adaptive, so ramping up to the target pressure can adaptively switch between a positively and negatively sloped ramping function. For example, if the system 10 is utilizing a soft start target pressure obtained from the soft start profile 306 as an input to the closed loop pressure control system 272 and it is determined that the DC bus current exceeds a predefined current limit, the ramp can go down the opposite slope as illustrated by the profile 310 until the current is once again below the predefined current limit wherein ramping along the positive slop of soft start profile 306 is resumed. This process can be repeated as necessary until the target pressure is obtained. Accordingly, the soft start mode 304 provides a moving target pressure that is utilized by the closed loop pressure control mode 272 to obtain the error (soft start moving target pressure minus measured pressure) which is transformed into the commanded RPM by the pressure control PID process 390. Notwithstanding, and in one embodiment, the ramp rate would be empirically derived for a given system such that having to move down the ramp is a rare event.

Figure 37:
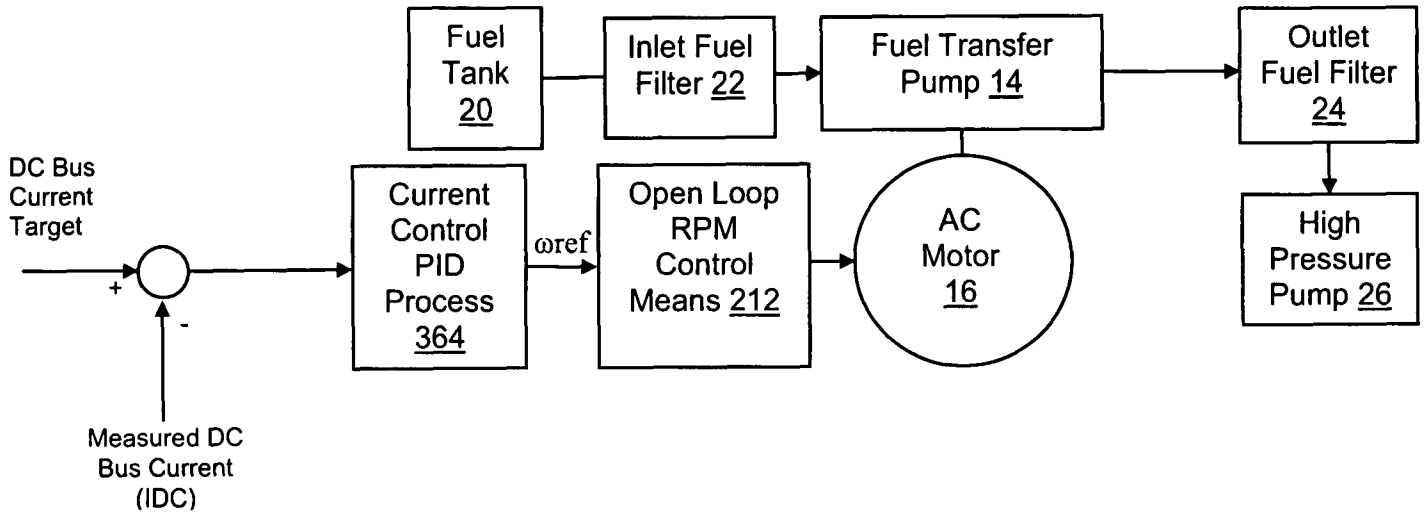
FIG. 37 is a diagrammatic view of an embodiment of a current control mode of the multi-mode control process of the fuel transfer pump system.

Referring now to FIGS. 36 and 37, the fuel transfer pump system 10 can dynamically switch from the pressure control mode 272 controlling the motor 16 to drive the pump 14 for pumping fuel as a function of the pressure feedback signal from the pressure transducer 36 to the current control mode 282 for controlling the motor 16 to drive the pump 14 as a function of a predetermined current threshold correlative to one or more anomalous conditions thereby precluding the system electronics from overheating and becoming damaged. Examples of these anomalous conditions include pump overload and/or one or more clogged outlet fuel filters 24 (stage II filters). In one embodiment, clogged outlet fuel filters 24 (stage II filters) when the DC current was over 50A and pressure dropped 5 psi from its target. In general, a clogged filter is based on both a pressure and current threshold wherein a clogged inlet filter(s) (Stage I) is indicative of a high RPM and a low current and a clogged outlet fuel filter(s) (Stage II) is indicative of low RPM and a high current. In other words, a high RPM (motor speed) and a low current is correlative to an inlet filter clog and a high current and a drop in pressure is correlative to an outlet filter clog.

FIG. 37 diagrammatically illustrates the current control mode 282 (Mode 2) wherein a DC bus current target or set point (e.g., 40 amps) is summed with a negative of a DC bus current measurement (measured by DC bus current transducer means 54) for obtaining an error. This error is then ran through the current control PID process 364 to obtain a commanded RPM in the current control mode 282 for controlling the AC motor 16 for driving the pump 14 for controlling the flow rate of fuel so as not to exceed the DC bus current target or set point. The closed loop of the measured DC bus current (IDC) is utilized to drive the summation or error to zero. Additionally, the summation is part of the current control PID process 364.

Hence, in current control mode 282, the system 10 deliveries as much fuel as it can without exceeding a predetermined maximum current level. Accordingly, the system 10 can delivery fuel flow but at a level below target pressure so that the engine can run, but not at full power. In one scenario, the pressure transducer is operating, but senses a flow restriction. Thus, if the system 10 is measuring DC bus current that is greater than the predetermined maximum, and the pressure is below target pressure, then the system goes into current control mode 282 to safely deliver fuel pressure without exceeding the predetermined maximum current level.

The DC bus Voltage Compensation control mode 292 (Mode 3) solves the problem of having a difference or sag between a DC design voltage and the actual DC voltage provided by the power source 12. For example, if the designed voltage is 24 volts at 3600 RPM, then if the power source voltage is actually 20 volts the system 10 cannot be run at 3600 RPM, but be at a point on the Volts/Hertz profile or curve 214 (FIG. 2) that has a one a one to one correspondence between 20 volts and an RPM given by the /Hertz profile or curve 214.

Referring back to FIG. 36, the DC bus Voltage Compensation control mode 292 (Mode 3) comprises the DC Bus Voltage Compensation PID Control process 438 cascaded with the pressure control HD process 390. That is, the output of the DC Bus Voltage Compensation PID Control process 438 serves as the input to the pressure control PID process 390. Accordingly, the DC Bus Voltage Compensation PID Control process 438 first determines a maximum allowed RPM (Max RPM) for a measured DC bus voltage (VDC) from the Volts/Hertz profile or curve 214 (FIG. 2). Then, the maximum allowed RPM is summed with a negative of the commanded RPM looped back from the output of the Pressure Control PID Process 390 for obtaining an error. This error is then ran through the DC Bus Voltage Compensation PID Control process 438 to obtain a target pressure associated with the measured DC bus voltage. This target pressure is then input into the Pressure Control PID process 390 for controlling the AC motor 16 for driving the pump 14 for controlling the flow rate of fuel for obtaining the target pressure associated with the measured DC bus voltage thereby compensating for voltage fluctuations of the power source 12.

During start up, the target pressure obtained from the DC Bus Voltage Compensation HD Control process 438 is utilized by the soft start mode 304 for bidirectionally ramping up a moving target pressure to the target pressure associated with the measured DC bus voltage.

Hence, the DC bus Voltage Compensation control mode 292 (Mode 3) adjusts the maximum available RPM as a function of DC bus voltage fluctuations for protecting the AC motor from excessive current and for protecting the AC motor and the associated electronics from overheating. Additionally, the DC bus Voltage Compensation control mode 292 (Mode 3) is employed in combination with the current control mode 282 (Mode 2) to assure that a target pressure associated with a sag in DC Bus voltage is not exceeded.

Accordingly, when the system 10 is in Mode 3, it is also in Modes 1 or 2 or, in other words, Mode 3 is a parent of Mode 1 or 2 when Mode 3 is active.

The open loop ramp down mode 302 (Mode 4) utilizes the open loop rpm control 212 (FIG. 3) for ramping open loop motor RPMs to zero from any of the other control modes of operation.

Accordingly, it should be apparent that further numerous modifications and adaptations may be resorted to without departing from the scope and fair meaning of the present invention as set forth hereinabove and as described herein below by the claims.

We claim:

1. A method for controlling a fuel transfer pump delivering fuel to a high pressure fuel injection pump; said method comprising:

providing a fuel transfer pump having an inlet port which is connectable in fluid communication with a fuel source and an outlet port which is connectable in fluid communication with a high pressure fuel injection pump;

providing a motor for driving the fuel transfer pump for drawing fuel through the inlet port from the fuel source and pumping pressurized fuel out the outlet port;

measuring a fuel pressure at a location which is in fluid communication with the outlet port;

controlling an operating speed of the motor driving the fuel transfer pump as a function of the measured fuel pressure for defining a closed loop pressure control mode for controlling the measured fuel pressure to a target fuel pressure;

measuring a current utilized in operating the motor;

comparing the measured current to a predefined threshold current value;

correlating the measured current to at least one anomalous condition when indicated by the comparison step; and switching from the closed loop pressure control mode for controlling the operating speed of the motor as a function of the measured fuel pressure to a current control mode for controlling the operating speed of the motor as a function of the measured current when the measured current is correlated by the correlation step to at least the one anomalous condition.

2. The method of claim 1 wherein at least the one anomalous condition is indicative of an obstruction of the fluid communication between the outlet port of the fuel transfer pump and the high pressure fuel injection pump.

3. The method of claim I Wherein at least the one anomalous condition is indicative of a clogged filter which is connectable in fluid communication between the outlet port of the fuel transfer pump and the high pressure fuel injection pump.

4. A method for controlling a fuel transfer pump delivering fuel to a high pressure fuel injection pump; said method comprising:

providing a fuel transfer pump having an inlet port which is connectable in fluid communication with a fuel source and an outlet port which is connectable in fluid communication with a high pressure fuel injection pump;

providing a motor for driving the fuel transfer pump for drawing fuel through the inlet port from the fuel source and pumping pressurized fuel out the outlet port;

measuring a fuel pressure at a location which is in fluid communication with the outlet port;

controlling an operating speed of the motor driving the fuel transfer pump as a function of the measured fuel pressure for defining a closed loop pressure control mode for controlling the measured fuel pressure to a target fuel pressure;

measuring a current utilized in operating the motor:

comparing the measured current to a predefined threshold current value;

correlating the measured current to at least one anomalous condition when indicated by the comparison step;

switchng from the closed loop pressure control mode for controlling the operating speed of the motor as a function of the measured fuel pressure to a current control mode for controlling the operating speed of the motor as a function of the measured current when the measured current is correlated by the correlation step to at least the one anomalous condition; and cascading a DC voltage compensation control mode with the closed loop pressure control mode for defining a value of the target fuel pressure as a function of a DC voltage utilized in operating the motor for compensating for DC voltage fluctuations.

5. A method for controlling a fuel transfer pump delivering fuel to a high pressure fuel injection pump; said method comprising:

providng a fuel transfer pump having an inlet port which is connectable in fluid communication with a fuel source and an outlet port which is connectable in fluid communication with a high pressure fuel injection pump;

providing a motor for driving the fuel transfer pump for drawing fuel through the inlet port from the fuel source and pumping pressurized fuel out the outlet port;

measuring a fuel pressure at a location which is in fluid communication with the outlet port;

controlling an operating speed of the motor driving the fuel transfer pump as a function of the measured fuel pressure for defining a closed loop pressure control mode for controlling the measured fuel pressure to a target fuel pressure;

measuring a current utilized in operating the motor;

comparing the measured current to a predefined threshold current value;

correlating the measured current to at least one anomalous condition when indicated by the comparison step;

switching from the closed loop pressure control mode for controlling the operating speed of the motor as a function of the measured fuel pressure to a current control mode for controlling the operating speed of the motor as a function of the measured current when the measured current is correlated by the correlation step to at least the one anomalous condition; and cascading a soft start mode with the closed loop pressure control mode for ramping up the current utilized in operating the motor when the current is below a predefined current limit and ramping down the current utilized in operating the motor when the current is above the predefined current limit until the target fuel pressure is substantially obtained.

6. The method of claim 5 further including a step of cascading a DC voltage compensation control mode with the soft start mode for defining a value of the target fuel pressure as a function of a DC voltage utilized in operating the motor for compensating for DC voltage fluctuations.

7. A method for controlling a fuel transfer pump delivering fuel to a high pressure fuel injection pump; said method comprising:

providing a fuel transfer pump having an inlet port which is connectable in fluid communication with a fuel source and an outlet port which is connectable in fluid communication with a high pressure fuel injection pump;

providing a motor for driving the fuel transfer pump for drawing fuel through the inlet port from the fuel source and pumping pressurized fuel out the outlet port;

measuring a fuel pressure which is in fluid communication with the outlet port;

controlling an operating speed of the motor driving the fuel transfer pump as a function of the measured fuel pressure for defining a closed loop pressure control mode for controlling the measured fuel pressure to a target fuel pressure;

measuring a current utilized in operating the motor;

comparing the measured current to a predefined threshold current value;

correlating the measured current to at least one anomalous condition when indicated by the comparison step;

switching from the closed loop pressure control mode for controlling the operating speed of the motor as a function of the measure fuel pressure to a current control mode for controlling the operating speed of the motor as a function of the measured current when the measured current is correlated by the correlation step to at least the one anomalous condition; and controlling the operating speed of the motor driving the fuel transfer pump under the closed loop pressure control mode for a predetermined amount of time when a measured fuel temperature is above a predetermined threshold value and further including a step of remeasuring the fuel temperature after the predetermined amount of time and continuing the step of controlling the operating speed of the motor driving the fuel transfer pump under the closed loop pressure control mode if the remeasured fuel temperature falls below the predetermined threshold value or further including a step of ramping down the motor to an off state if the remeasured fuel temperature remains above the predetermined threshold value.

8. A method for minimizing current inrush to a fuel transfer pump upon initial start up; said method comprising:

providing a fuel transfer pump having an inlet port which is connectable in fluid communication with a fuel source and an outlet port which is connectable in fluid communication with a high pressure fuel injection pump;

providing a motor for driving the fuel transfer pump for drawing fuel through the inlet port from the fuel source and pumping pressurized fuel out the outlet port;

measuring a fuel pressure at a location which is in fluid communication with the outlet port;

controlling an operating speed of the motor driving the fuel transfer pump as a function of the measured fuel pressure and a moving fuel pressure;

measuring a current utilized in operating the motor;

comparing the measured current to a predefined threshold current value; and utilizing a soft start mode for ramping up the current utilized in operating the motor when the measured current is below the predefined threshold current value as indicated by the comparison step and ramping down the current utilized in operating the motor when the current is above the predefined threshold current value as indicated by the comparison step for providing the moving fuel pressure until the moving fuel pressure reaches a target fuel pressure.

9. A fuel transfer pump system for delivering fuel to a high pressure pump of a fuel injection system, said fuel transfer pump system comprising:

a fuel transfer pump having an inlet port which is connectable in fluid communication with a source of fuel and an outlet port which is connectable in fluid communication with a high pressure fuel injection pump;

a motor for driving said fuel transfer pump for drawing fuel through said inlet port from said fuel source and pumping pressurized fuel out said outlet port at a target fuel pressure;

means for measuring fuel pressure at a location in fluid communication with said outlet port of said fuel transfer pump;

means for measuring current utilized in operating said motor; and a controller operatively coupled to said motor and connected in signal communication with said fuel pressure measuring means and said current measuring means, said controller being configured to adaptively switch between a closed loop pressure control mode for controlling an operating speed of said motor for obtaining said target fuel pressure as a function of said measured fuel pressure to a current control mode for controlling said operating speed of said motor as a function of said measured current when said measured current is correlated to at least one anomalous condition based on a comparison between said measured current and a predefined threshold current value.

10. The system of claim 9 wherein at least said one anomalous condition is indicative of an obstruction of the fluid communication between said outlet port of said fuel transfer pump and said high pressure fuel injection pump.

11. The system of claim 9 wherein at least said one anomalous condition is indicative of a clogged filter which is connectable in fluid communication between said outlet port of said fuel transfer pump and said high pressure fuel injection pump.

12. A fuel transfer pump system for delivering fuel to a high pressure pump of a fuel injection system, said fuel transfer pump system comprising:

a fuel transfer pump having an inlet port which is connectable in fluid communication with a source of fuel and an outlet port which is connectable in fluid communication with a high pressure fuel injection pump;

a motor for driving said fuel transfer pump for drawing fuel through said inlet port from said fuel source and pumping pressurized fuel out said outlet port at a target fuel pressure;

means for measuring fuel pressure at a location in fluid communication with said outlet port of said fuel transfe pump;

means for measuring current utilized in operating said motor; and a controller operatively coupled to said motor and connected in signal communication with said fuel pressure measuring means and said current measuring means, said controller being configured to adaptively switch between a closed loop pressure control mode for controlling an operating speed of said motor for obtaining said target fuel pressure as a function of said measured fuel pressure to a current control mode for controlling said operating speed of said motor as a function of said measured current when said measured current is correlated to at least one anomalous condition based on a comparison between said measured current and a predefined threshold current value; and said controller being further configured to cascade a DC voltage compensation control mode with said closed loop pressure control mode for defining a value of said target fuel pressure as a function of a measured DC voltage utilized in operating said motor for compensating for DC voltage fluctuations.

13. A fuel transfer pump system for delivering fuel to a high pressure pump of a fuel injection system, said fuel transfer pump system comprising:

a fuel transfer pump having an inlet port which is connectable in fluid communication with a source of fuel and an outlet port which is connectable in fluid communication with a high pressure fuel injection pump;

a motor for driving said fuel transfer pump for drawing fuel through said inlet port from said fuel source and pumping pressurized fuel out said outlet port at a target fuel pressure;

means for measuring fuel pressure at a location in fluid communication with outlet port of said fuel transfer pump;

means for measuring current utilized in operating said motor; and a controller operatively coupled to said motor and connected in signal communication with fuel pressure measuring means and said current measuring means, said controller being configured to adaptively switch between a closed loop pressure control mode for controlling an operating speed of said motor for obtaining said target fuel pressure as a function of said measured fuel pressure to a current control mode for controlling said operating speed of said motor as a function of said measured current when said measured current is correlated to at least one anomalous condition based on a comparison between said measured current and a predefined threshold current value; and said controller being further configured to cascade a soft start mode with said closed loop pressure control mode for ramping up said current utilized in operating said motor when said current is below a predefined current limit and ramping down said current utilized in operating said motor when said current is above said predefined current limit until said target fuel pressure is substantially obtained.

14. The system of claim 13 wherein said controller being further configured to cascade a DC voltage compensation control mode with said soft start mode for defining a value of said target fuel pressure as a function of a DC voltage utilized in operating said motor for compensating for DC voltage fluctuations.

15. A fuel transfer pump system for delivering fuel to a high pressure pump of a fuel injection system, said fuel transfer pump system comprising:

a fuel transfer pump having an inlet port which is connectable in fluid communication with a source of fuel and an outlet port which is connectable in fluid communication with a high pressure fuel injection pump;

a motor for driving said fuel transfer pump for drawing fuel through said inlet port from said fuel source and pumping pressurized fuel out said outlet port at a target fuel pressure;

means for measuring fuel pressure at a location in fluid communication with said outlet port of said fuel transfer pump;

means for measuring current utilized in operating said motor; and a controller operatively coupled to said motor and connected in signal communication with said fuel pressure measuring means and said current measuring means, said controller being configured to adaptively switch between a closed loop pressure control mode for controlling an operating speed of said motor for obtaining said target fuel pressure as a function of said measured fuel pressure to a current control mode for controlling said operating speed of said motor as a function of said measured current when said measured current is correlated to at least one anomalous condition based on a comparison between said measured current and a predefined threshold current value, and said controller being further configured to control said operating speed of said motor driving said fuel transfer pump under said closed loop pressure control mode for a predetermined amount of time when a measured fuel temperature is above a predetermined threshold value and further configured to remeasure said fuel temperature after said predetermined amount of time and to control said operating speed of said motor driving said fuel transfer pump under said closed loop pressure control mode if said remeasured fuel temperature falls below said predetermined threshold value and said controller being further configured to ramp down said motor to an off state if said remeasured fuel temperature remains above said predetermined threshold value.

16. A non-transitory microcontroller-readable memory containing microcontroller-executable instructions that, when executed by a processor, cause the processor to perform a multi-mode control method of a motor driving a pump, said method comprising:

controlling an operating speed of a motor driving a pump for pressurizing fluid as a function of a measured pressure of the pressurized fluid for defining a closed loop pressure control mode for obtaining a target fluid pressure; and switching from the closed loop pressure control mode to a current control mode for controlling the operating speed of the motor as a function of a measured current utilized in operating the motor when the measured current is indicative of at least one anomalous condition.

17. A non-transitory microcontroller-readable memory containing microcontroller-executable instructions that, when executed by a processor, cause the processor to perform a multi-mode control method of a motor driving a pump, said method comprising:

controlling an operating weed of a motor driving a pump for pressurizing fluid as a function of a measured pressure of the pressurized fluid for defining a closed loop pressure control mode for obtainin a target fluid pressure; and switching from the closed loop pressure control mode to a current control mode for controlling the operating speed of the motor as a function of a measured current utilized in operating the motor when the measured current is indicative of at least one anomalous condition; and cascading a DC voltage compensation control mode with the closed loop pressure control mode for defining a value of the target fluid pressure as a function of a DC voltage utilized in operating the motor for compensating for DC voltage fluctuations,

18. A non-transitory microcontroller-readable memory containing microcontroller-executable instructions that, when executed by a processor, cause the processor to perform a multi-mode control method of a motor driving a pump, said method comprising:

controlling an operating speed of a motor driving a pump for pressurizing fluid as a function of a measured pressure of the pressurized fluid for defining a closed loop pressure control mode for obtaining a target fluid pressure; and switching from the closed loop pressure control mode to a current control mode for controlling the operating speed of the motor as a function of a measured current utilized in operating the motor when the measured current is indicative of at least one anomalous condition; and cascading a soft start mode with the closed loop pressure control mode for ramping up a current utilized in operating the motor when the current is below a predefined current limit and ramping down the current utilized in operating the motor when the current is above the predefined current limit until the target fluid pressure is substantially obtained.

19. The non-transitory microcontroller-readable memory of claim 18 further comprising a step of cascading a DC voltage compensation control mode with the soft start mode for defining a value of the target fluid pressure as a function of a DC voltage utilized in operating the motor for compensating for DC voltage fluctuations.

20. A non-transitory microcontroller-readable memory containing microcontroller-executable instructions that, when executed by a processor, cause the processor to perform a multi-mode control method of a motor driving a pump, said method comprising:

controlling an operating speed of a motor driving a pump for pressurizing fluid as a function of a measured pressure of the pressurized fluid for defining a closed loop pressure control mode for obtaining a target fluid pressure; and switching from the closed loop pressure control mode to a current control mode for controlling the operating speed of the motor as a function of a measured current utilized in operating the motor when the measured current is indicative of at least one anomalous condition; and controlling the operating speed of the motor driving the pump under the closed loop pressure control mode for a predetermined amount of time when a measured fluid temperature is above a predetermined threshold value and further including a step of remeasuring the fluid temperature after the predetermined amount of time and continuing the step of controlling the operating speed of the motor driving the pump under the closed loop pressure control mode if the remeasured fluid temperature falls below the predetermined threshold value or further including a step of ramping down the motor to an off state if the remeasured fluid temperature remains above the predetermined threshold value.

* * * * *